US011555308B2

(12) United States Patent
Vanker et al.

(10) Patent No.: US 11,555,308 B2
(45) **Date of Patent: *Jan. 17, 2023**

(54) METAL DECKING

(71) Applicant: PATCO, LLC, Arvada, CO (US)

(72) Inventors: John Louis Vanker, Denver, CO (US); Michael J. Lastowski, Centennial, CO (US)

(73) Assignee: PATCO, LLC, Arvada, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/129,244

(22) Filed: Dec. 21, 2020

(65) Prior Publication Data

US 2021/0108411 A1 Apr. 15, 2021

Related U.S. Application Data

(63) Continuation of application No. 16/360,823, filed on Mar. 21, 2019, now Pat. No. 10,870,986, which is a continuation-in-part of application No. 15/860,073, filed on Jan. 2, 2018, now Pat. No. 10,246,874, which is a continuation-in-part of application No. 15/217,589, filed on Jul. 22, 2016, now abandoned.

(60) Provisional application No. 62/195,677, filed on Jul. 22, 2015.

(51) Int. Cl.

| | |
|---|---|
| ***E04B 5/40*** | (2006.01) |
| ***E04B 1/24*** | (2006.01) |
| ***E04C 2/32*** | (2006.01) |
| ***E04C 2/08*** | (2006.01) |

(52) U.S. Cl.

CPC ..... *E04B 5/40* (2013.01); *E04B 1/24* (2013.01); *E04C 2/08* (2013.01); *E04C 2/322* (2013.01); *E04B 2001/2484* (2013.01); *E04B 2103/06* (2013.01)

(58) Field of Classification Search

CPC ..... E04B 5/40; E04B 1/24; E04B 2001/23; E04B 2103/06; E04C 2/322; E04C 2/08

See application file for complete search history.

(56) References Cited

U.S. PATENT DOCUMENTS

| | | | |
|---|---|---|---|
| 4,653,237 | A | 3/1987 | Taft |
| 2004/0231276 | A1 | 11/2004 | Patrick et al. |
| 2010/0192507 | A1 | 8/2010 | Studebaker et al. |
| 2015/0159386 | A1 | 6/2015 | Dinmore et al. |

FOREIGN PATENT DOCUMENTS

| | | | |
|---|---|---|---|
| JP | H07-034115 | U | 6/1995 |
| JP | H07-0279291 | A | 10/1995 |
| JP | H07-317220 | A | 12/1995 |

(Continued)

OTHER PUBLICATIONS

International Search Report issued for Application PCT/US2016/043735, dated Oct. 26, 2016.

*Primary Examiner* — Beth A Stephan

(74) *Attorney, Agent, or Firm* — Holzer Patel Drennan

(57) ABSTRACT

In one implementation, a metal deck is provided that includes one or more deck components formed in a contiguous metal sheet. Each of the deck components includes one or more folded ribs formed along the length of the metal deck. Each of the one or more folded ribs are configured such that one or more trusses of a building may fit between the one or more folded ribs. The metal deck may be used to complete the structural diaphragm without using concrete.

20 Claims, 22 Drawing Sheets

(56) References Cited

FOREIGN PATENT DOCUMENTS

| | | | |
|---|---|---|---|
| JP | H09-165863 | A | 6/1997 |
| JP | 2582276 | Y2 | 9/1998 |
| JP | 2012-140750 | A | 7/2012 |
| KR | 100882163 | Y1 | 2/2009 |
| WO | 2007-085076 | A1 | 8/2007 |

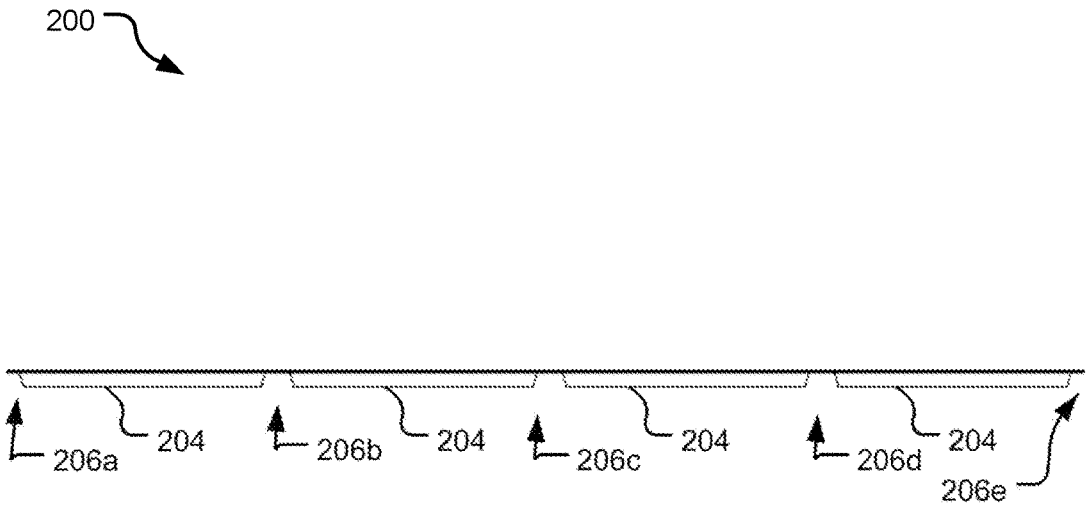
FIG. 2A
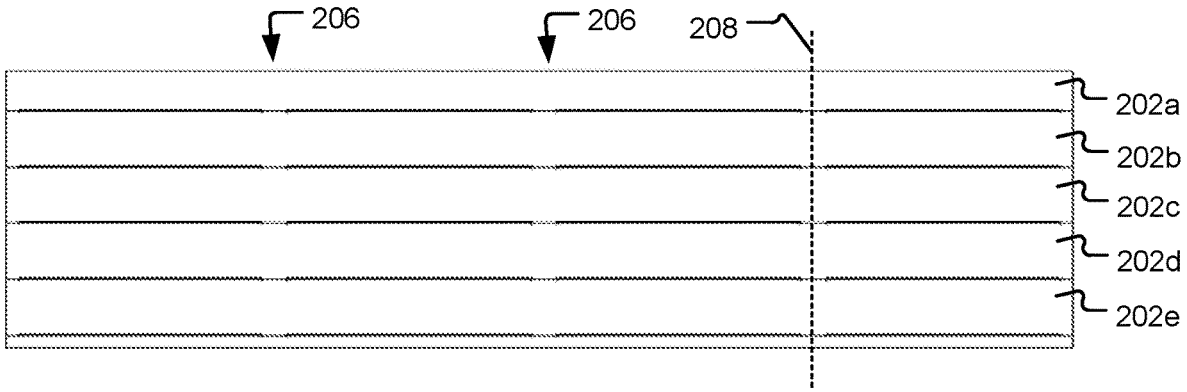
FIG. 2B
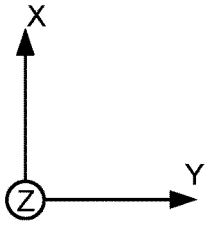

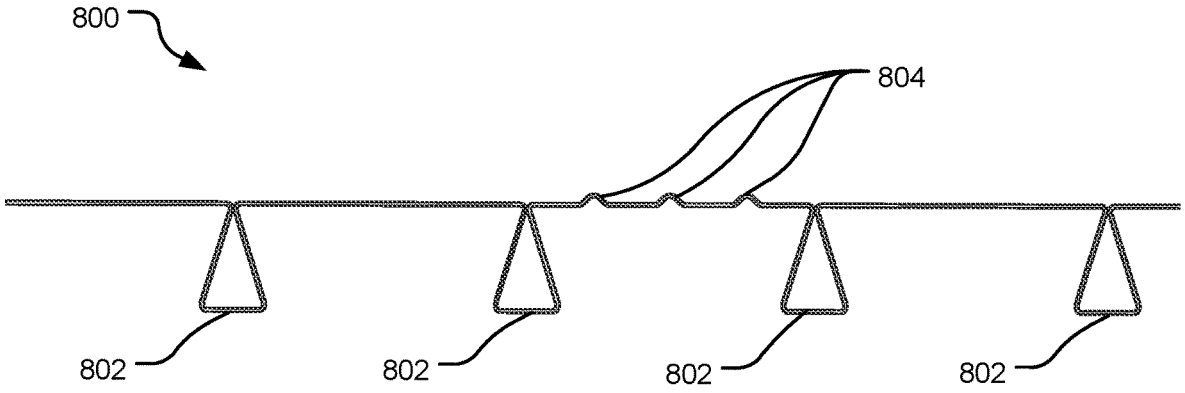
FIG. 8A
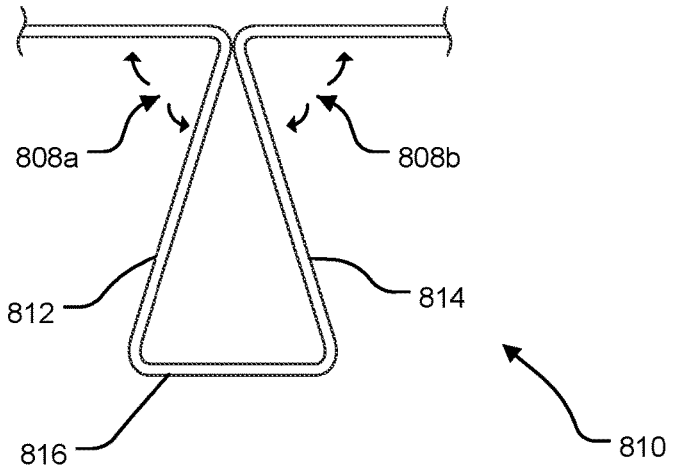
FIG. 8B
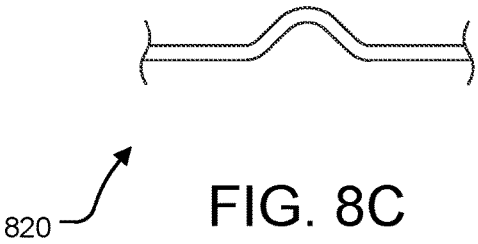
FIG. 8C
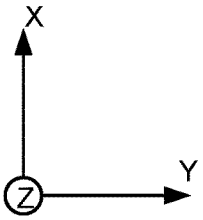

DETAIL B

DETAIL A

DETAIL C

METAL DECKING

CROSS-REFERENCE TO RELATED APPLICATIONS

The present application is a continuation of and claims the benefit of U.S. Non-Provisional patent application Ser. No. 16/360,823 filed Mar. 21, 2019, and entitled "METAL DECKING," which is a continuation in part of and claims benefit of U.S. Non-Provisional patent application Ser. No. 15/860,073, filed Jan. 2, 2018, and now U.S. Pat. No. 10,246,874 issued Apr. 2, 2019, which is a continuation in part and claims benefit of U.S. Non-Provisional application Ser. No. 15/217,589 filed on Jul. 22, 2016, which claims the priority and benefit of U.S. Provisional Application Ser. No. 62/195,677 filed on Jul. 22, 2015 and entitled "METAL DECKING," all of which are incorporated herein by reference in their entirety.

BACKGROUND

Composite decking may be used as floor and/or ceiling components for single or multiple-story buildings. The composite decking is used to complete the structural diaphragm of the building. Composite decking includes a contiguous metal sheet having concrete formed thereon. Composite decking may include a mesh structure to give the concrete rigidity.

SUMMARY

In one implementation, a metal deck is provided that includes a plurality of deck components formed along a width of the metal deck and including an elevated section and a ribbed section, the elevated section configured to provide sound insulation between the metal deck and a truss structure, the ribbed section including a rib flute extending from a bottom surface of the metal deck, the ribbed section further including a first elevated rib positioned adjacent to a first side of the rib flute and a second elevated rib positioned adjacent to a second side of the rib flute, the first elevated rib and the second elevated rib being substantially parallel to the rib flute, the ribbed section including the rib flute, the first elevated rib, and the second elevated rib extending along a length of the metal deck.

BRIEF DESCRIPTIONS OF THE DRAWINGS

A further understanding of the nature and advantages of the present technology may be realized by reference to the figures, which are described in the remaining portion of the specification. In the figures, like reference numerals are used throughout several figures to refer to similar components. In some instances, a reference numeral may have an associated sub-label consisting of a lower-case letter to denote one of multiple similar components. When reference is made to a reference numeral without specification of a sub-label, the reference is intended to refer to all such multiple similar components.

FIG. 2A illustrates a side view of an example metal deck, and FIG. 2B illustrates a top view of an example metal deck.

FIGS. 8A-8C illustrate example side views of an example metal deck disclosed herein.

Figure 11:
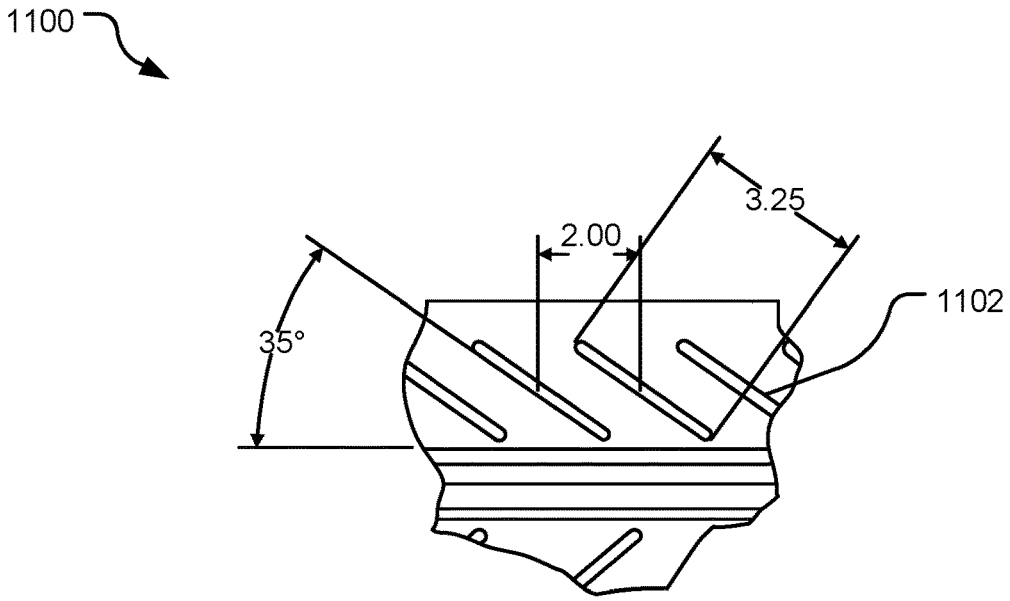
Figure 11:
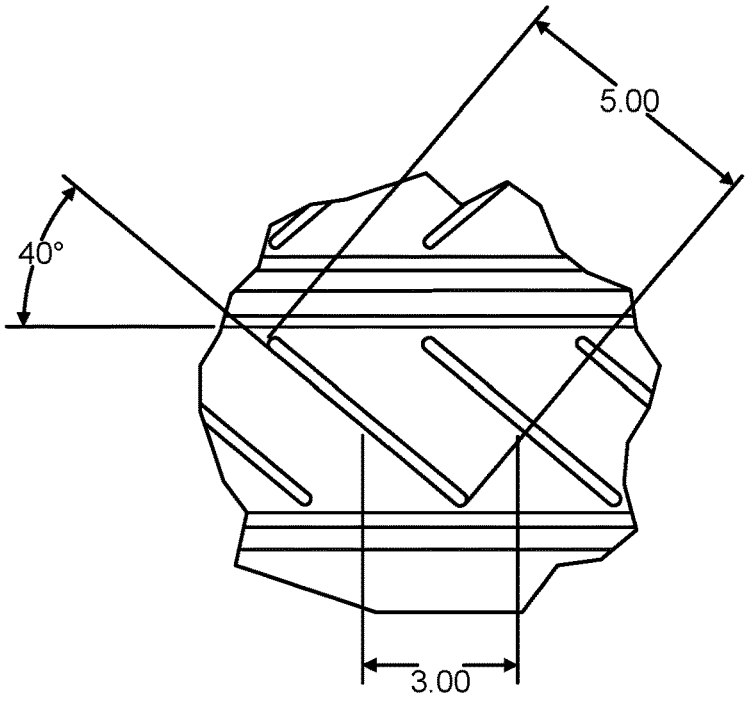

FIG. 11 illustrated an example top view of portions of the metal deck disclosed herein.

Figure 12:
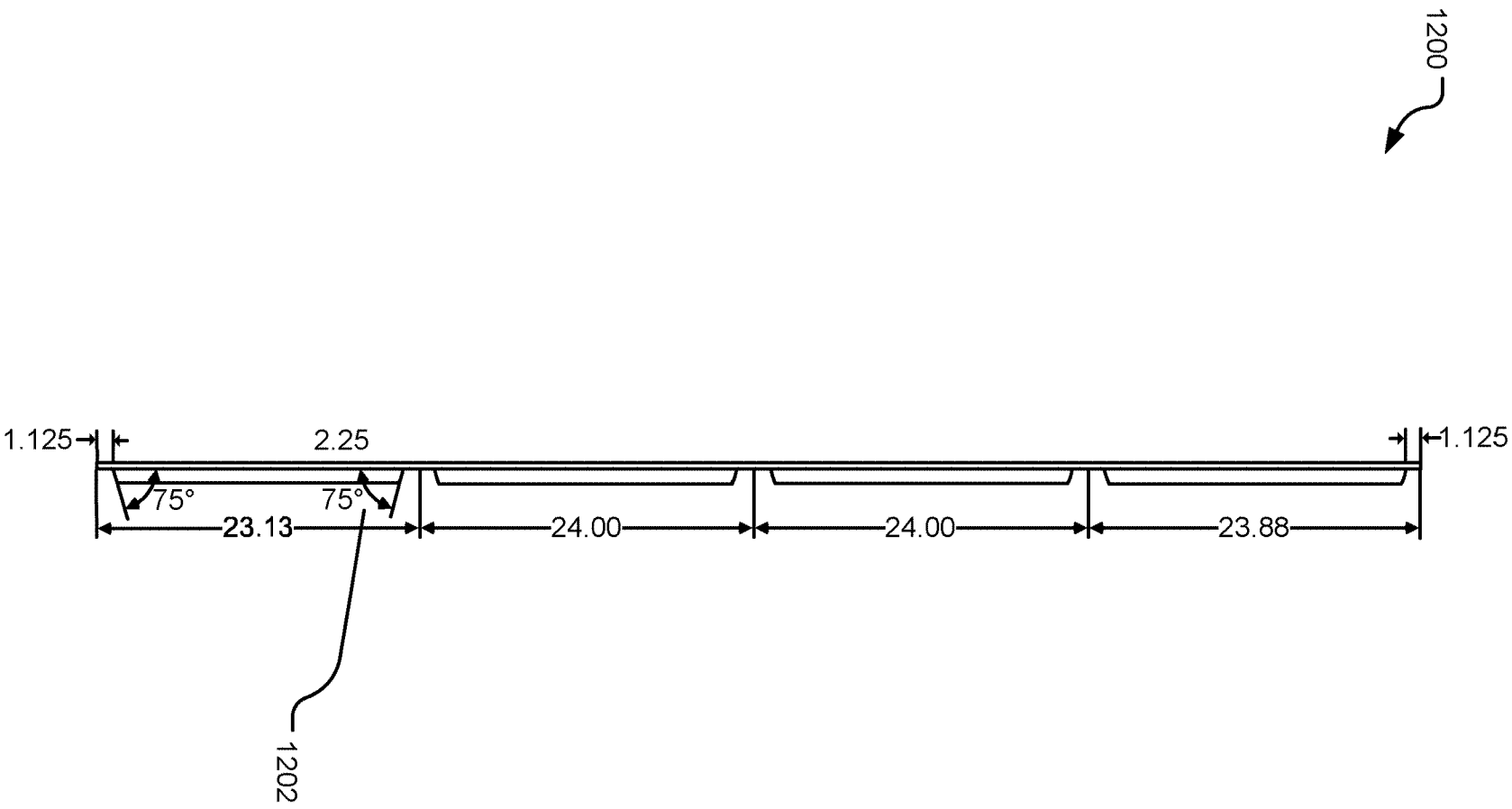

FIG. 12 discloses an alternative view of example metal deck disclosed herein.

Figure 13:
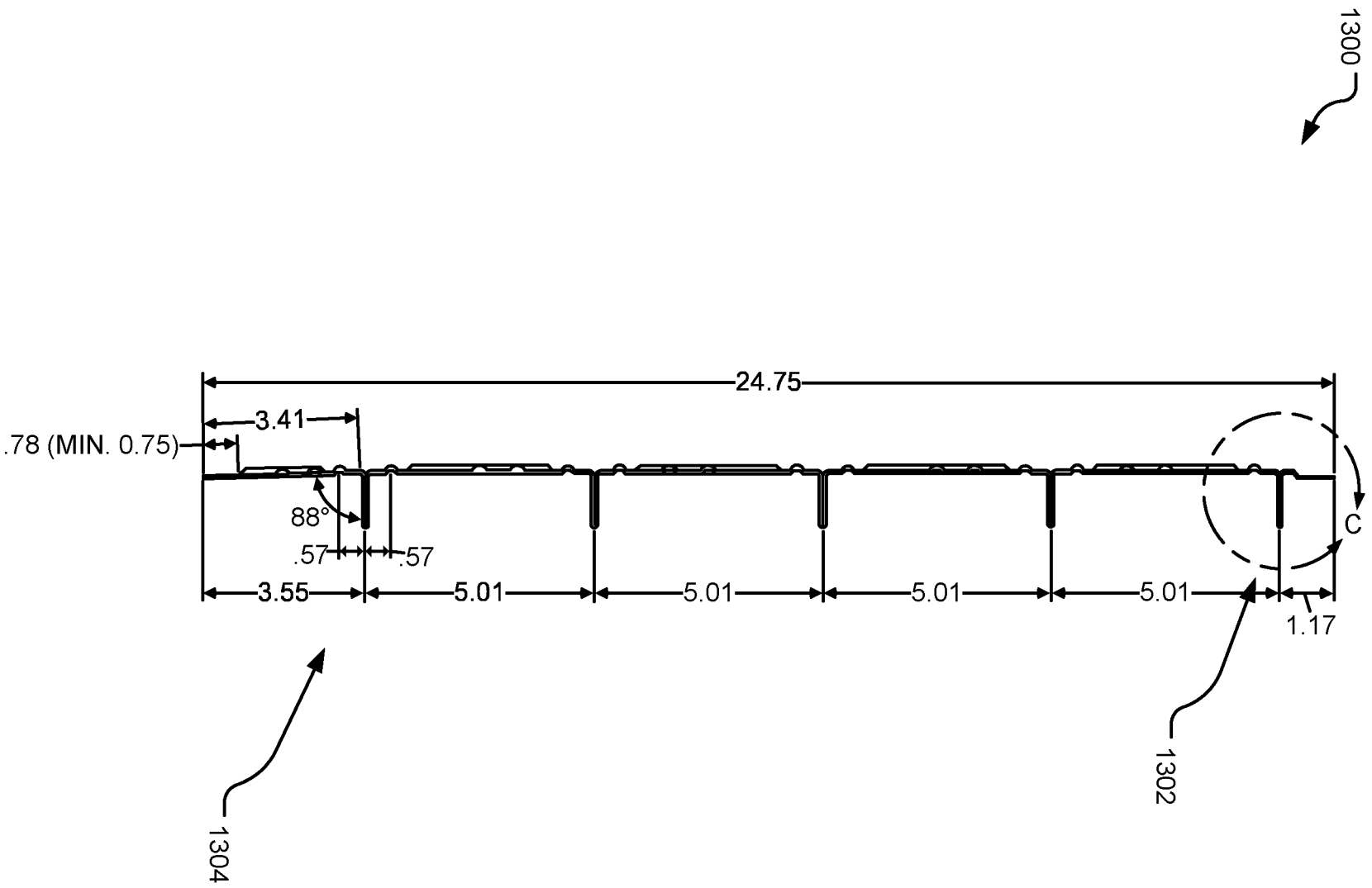

FIG. 13 illustrates yet another alternative view of example metal deck disclosed herein.

Figure 14:
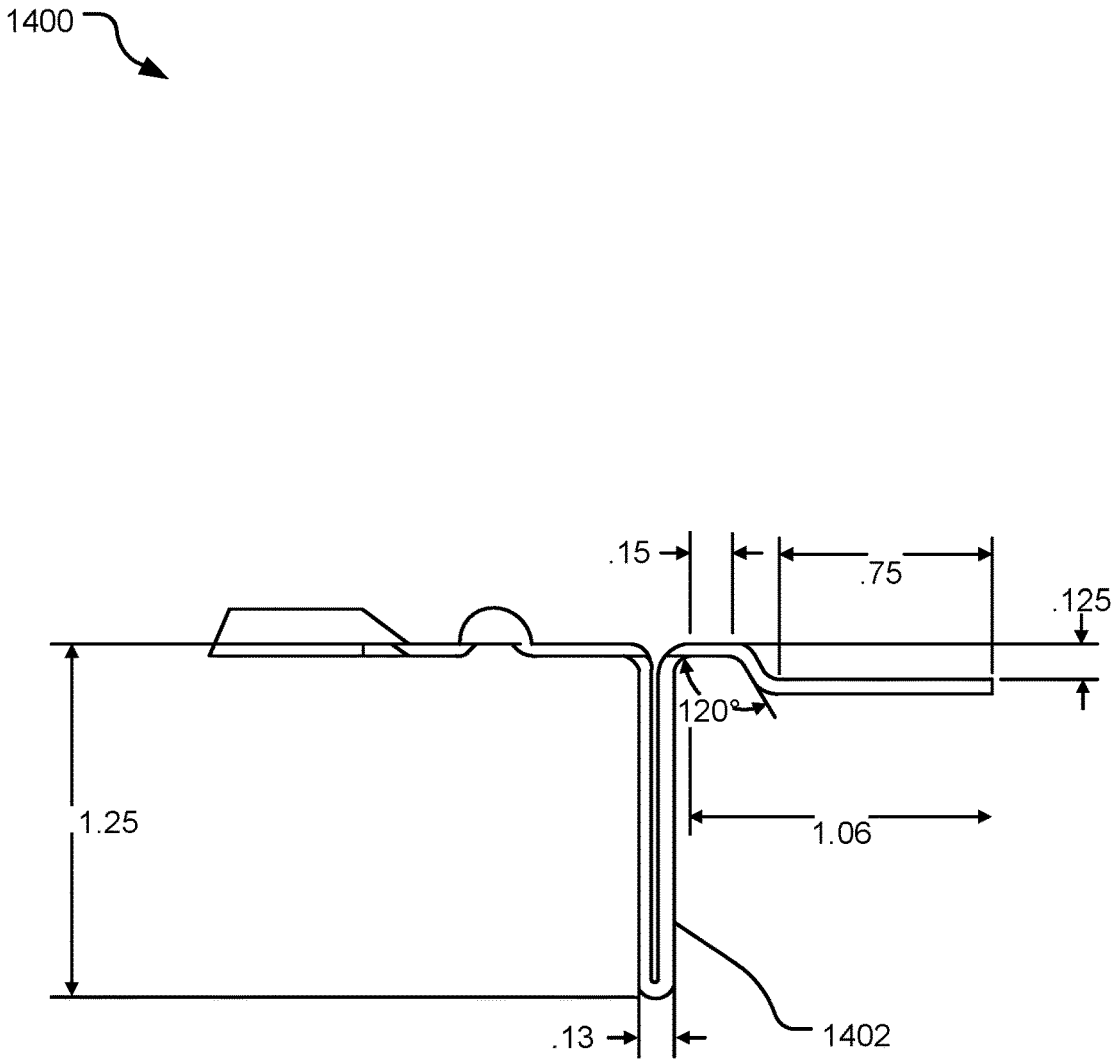

FIG. 14 illustrates a side view of the example metal deck disclosed herein.

Figure 15:
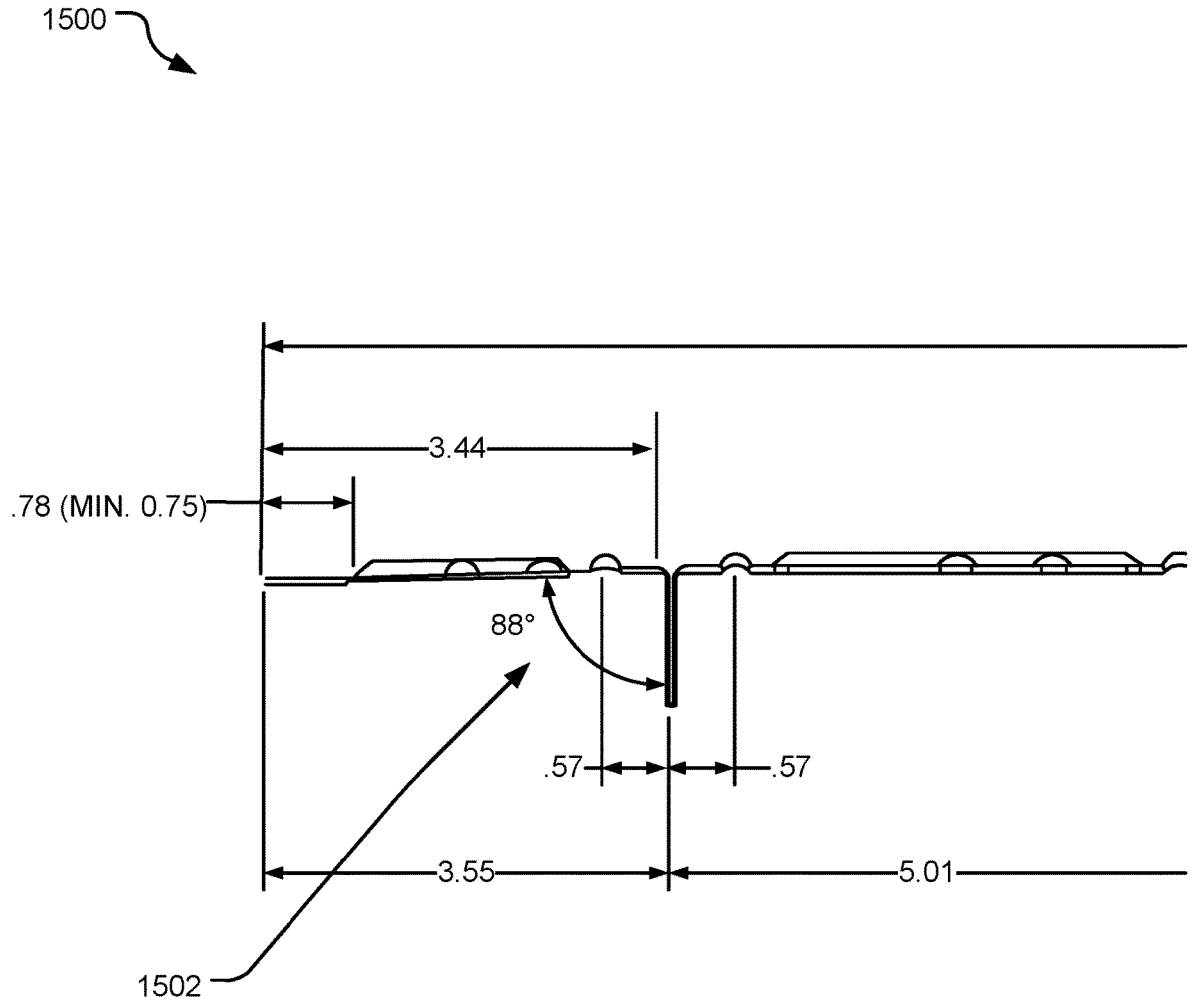

FIG. 15 illustrates another alternative side view of the metal deck disclosed herein.

Figure 16:
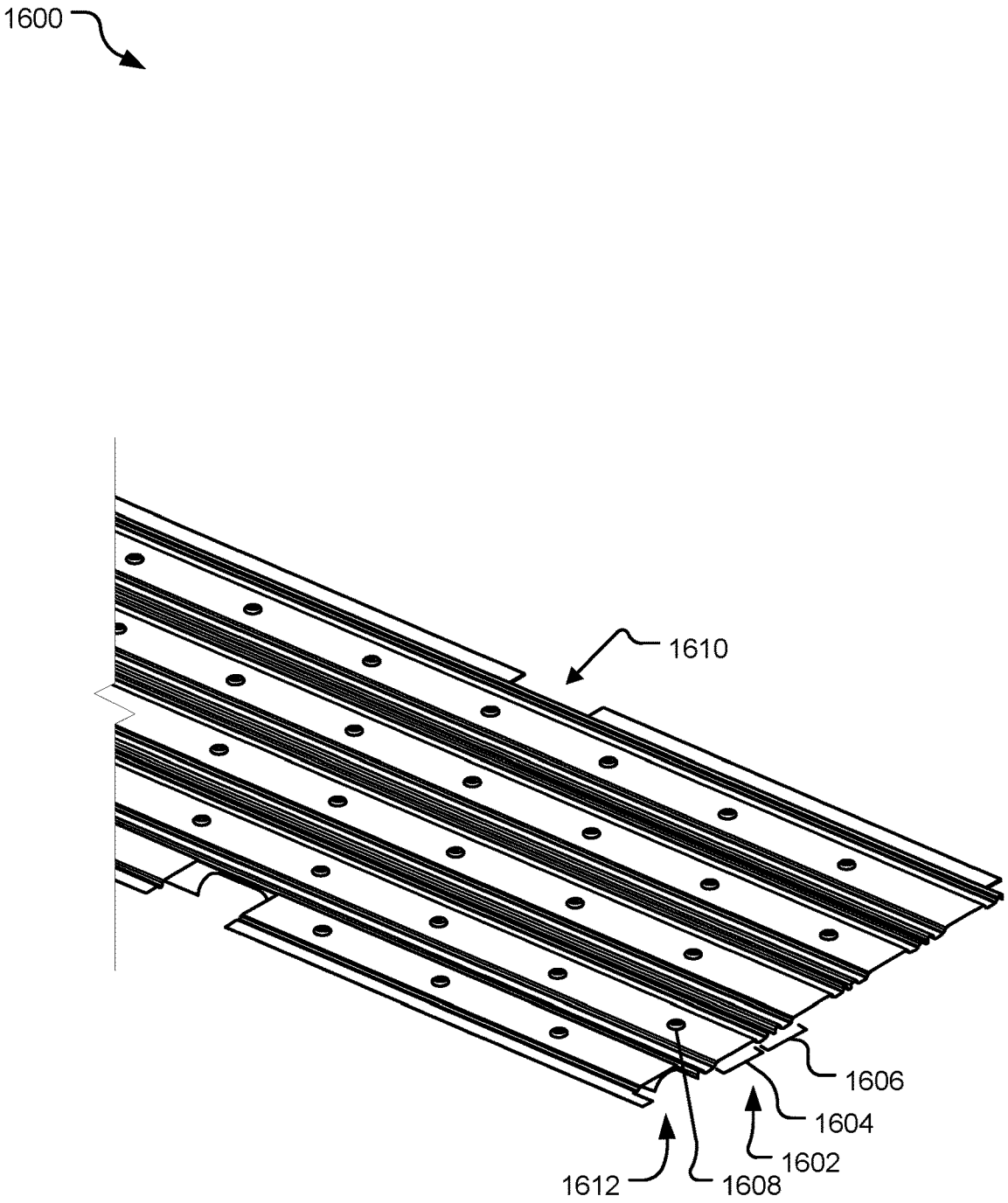

FIG. 16 illustrates another view of another example metal deck disclosed herein.

Figure 17:
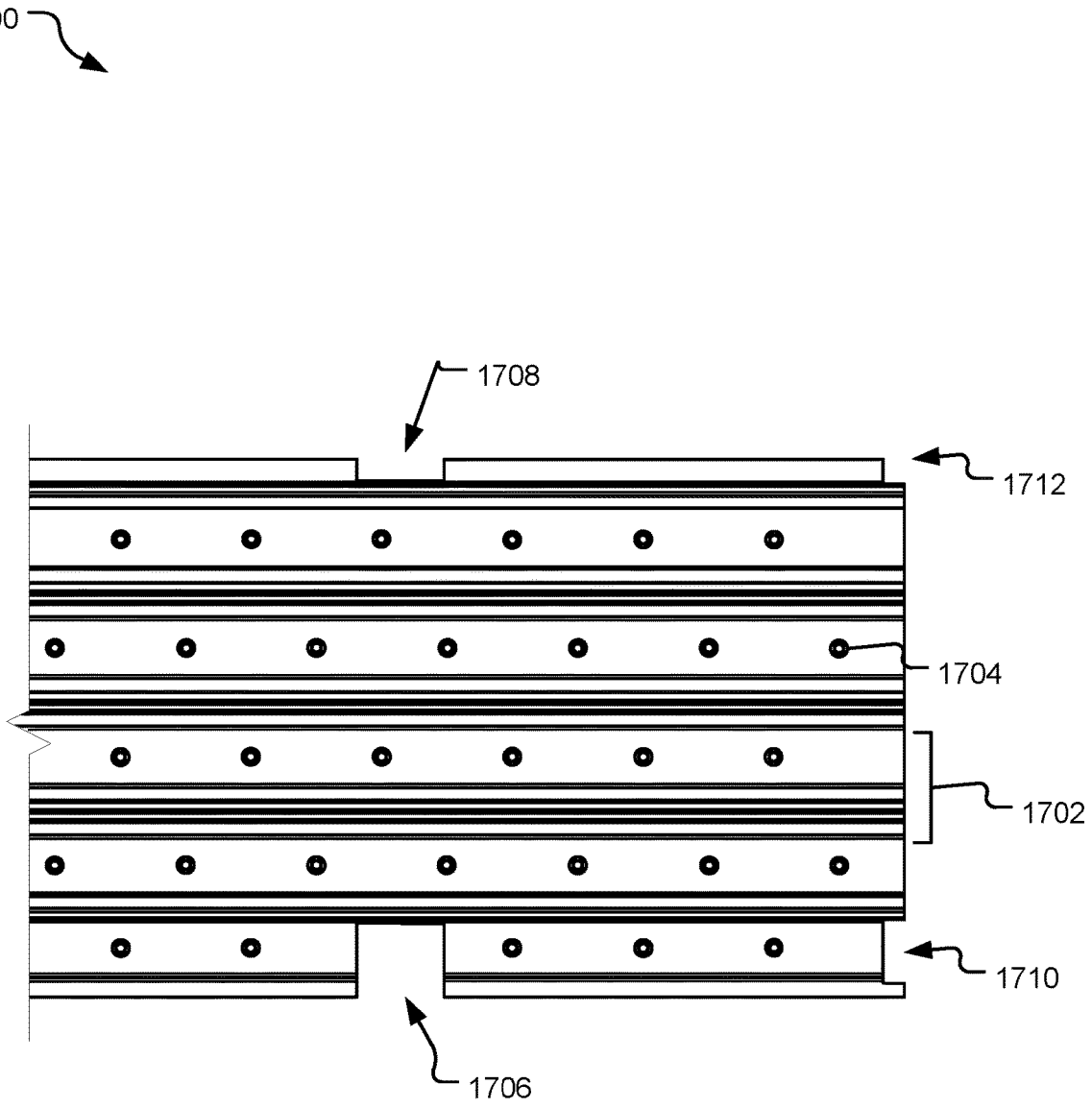

FIG. 17 illustrates a top view of an example metal deck disclosed herein.

Figure 18:
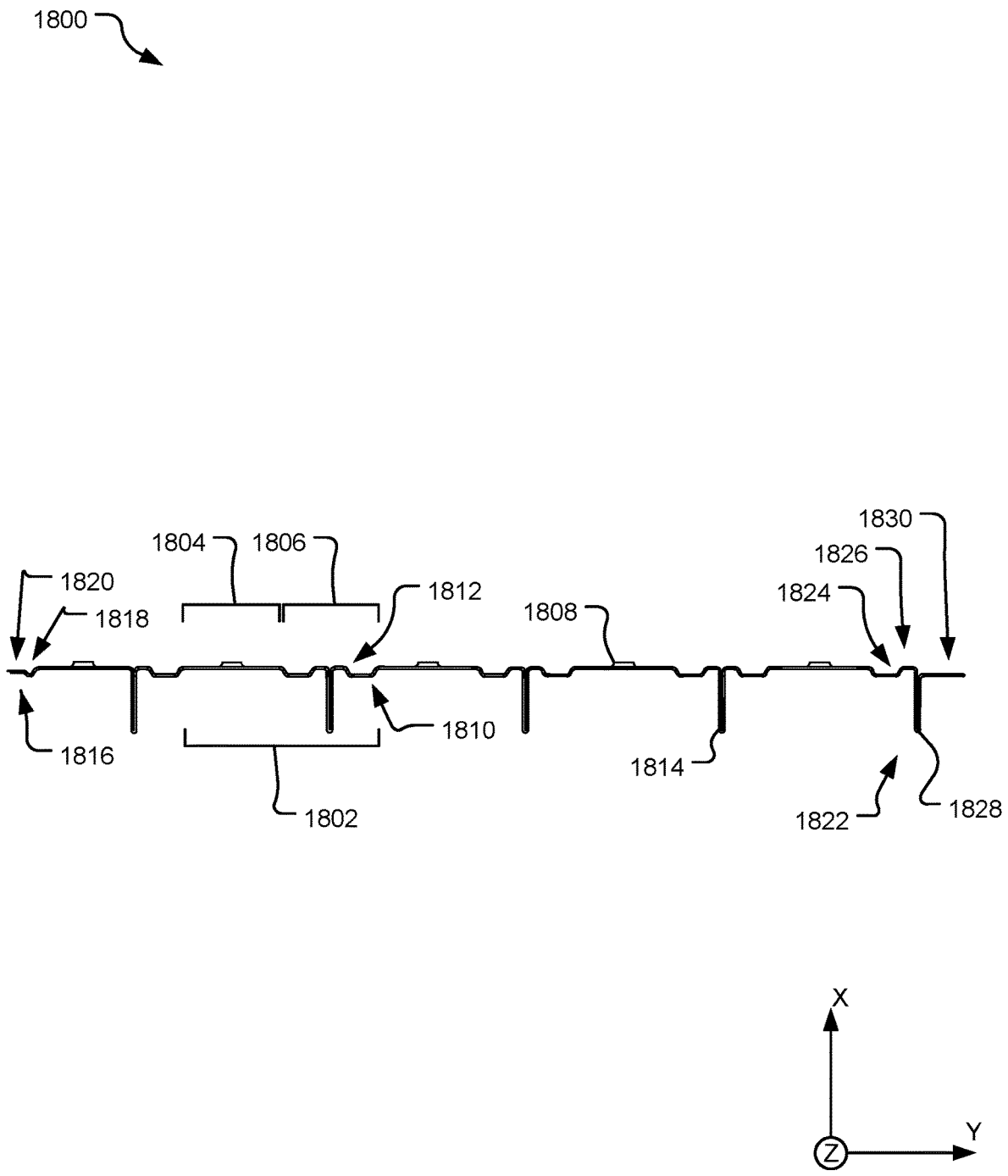
Figure 19:
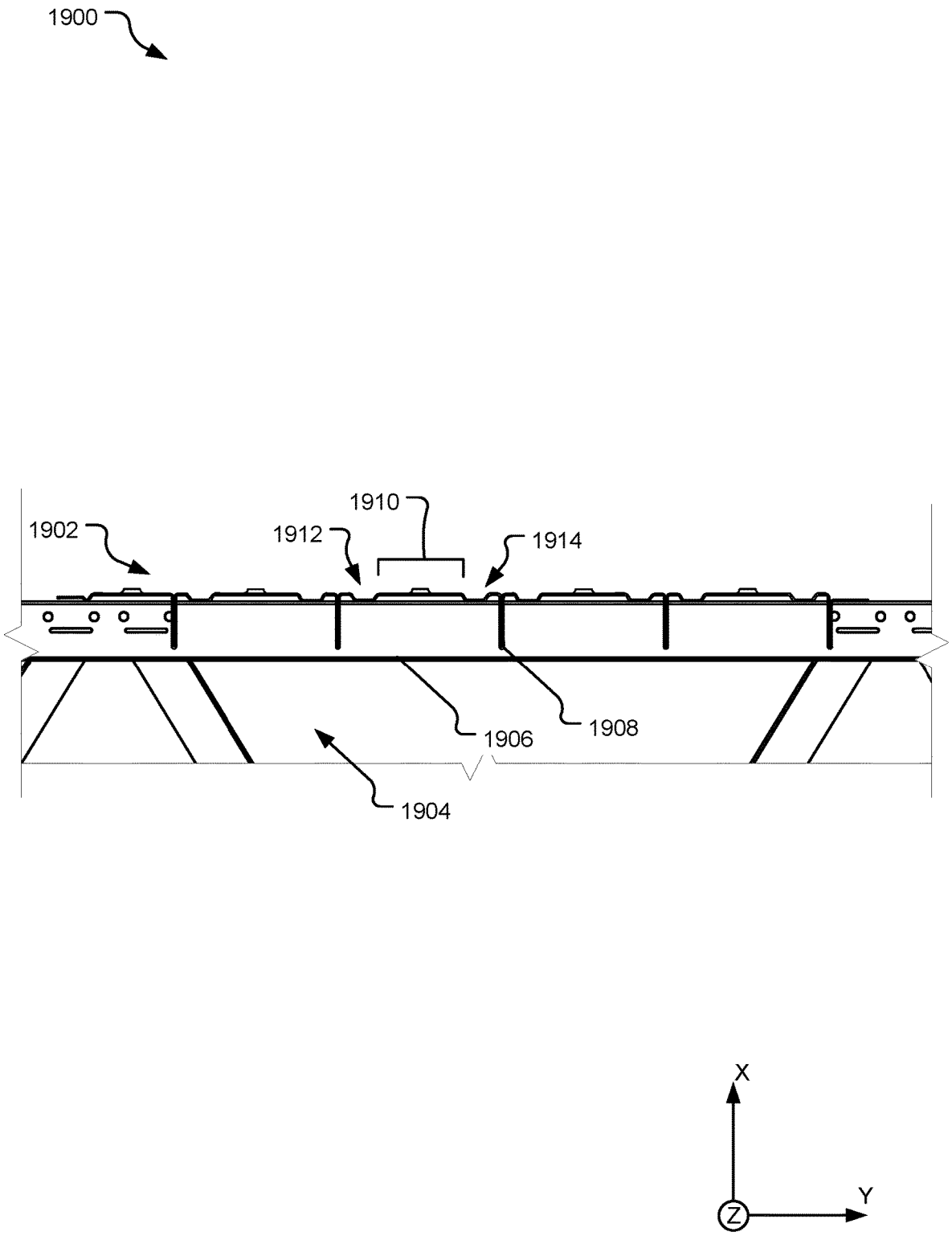

FIG. 18 illustrates a side cross-sectional view of an example metal deck disclosed herein FIG. 19 illustrates a side cross-sectional view of an example metal deck disclosed herein positioned on top of a truss structure.

Figure 20:
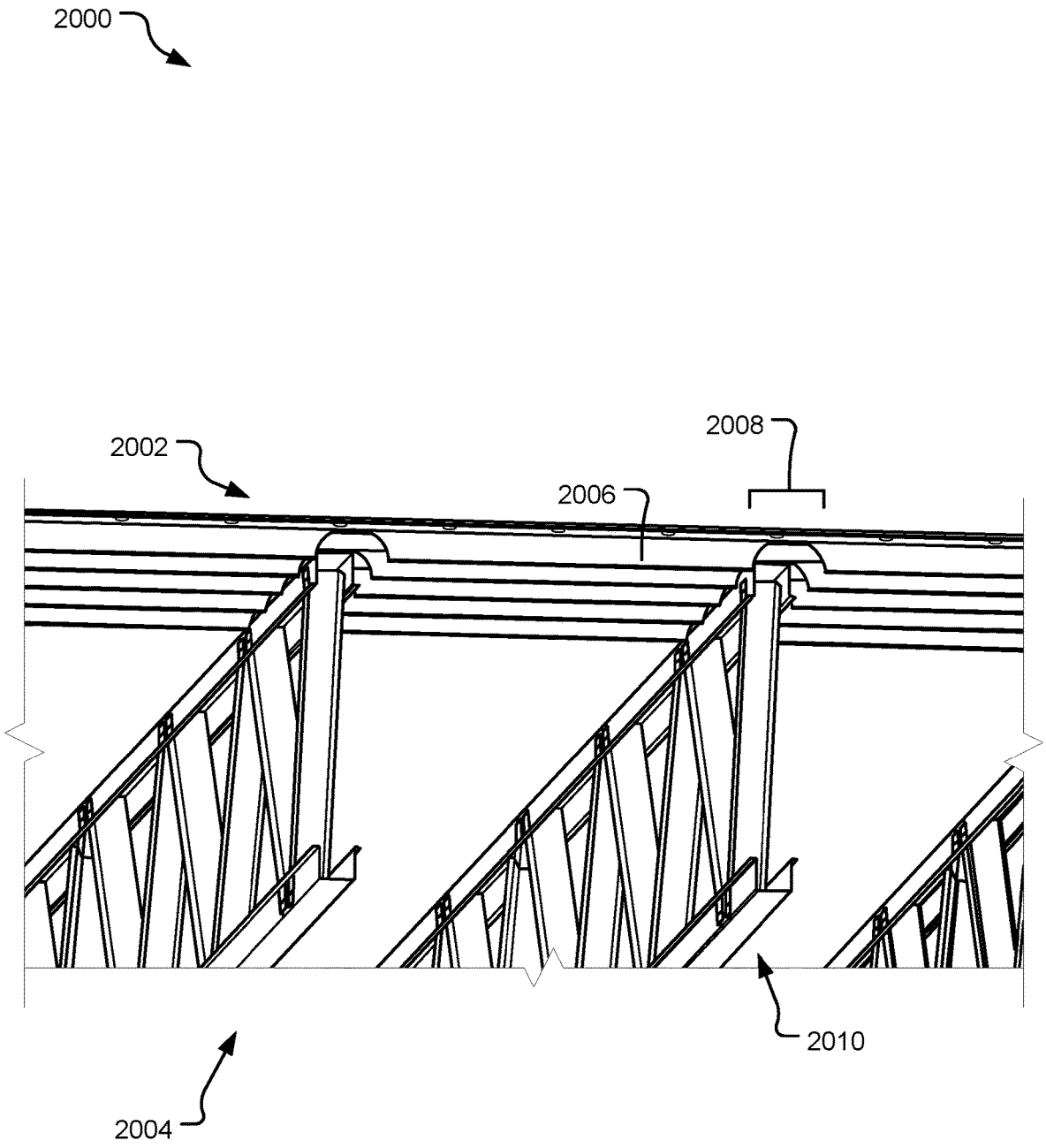

FIG. 20 illustrates another view of an example metal deck disclosed herein positioned on top of a truss structure.

Figure 21:
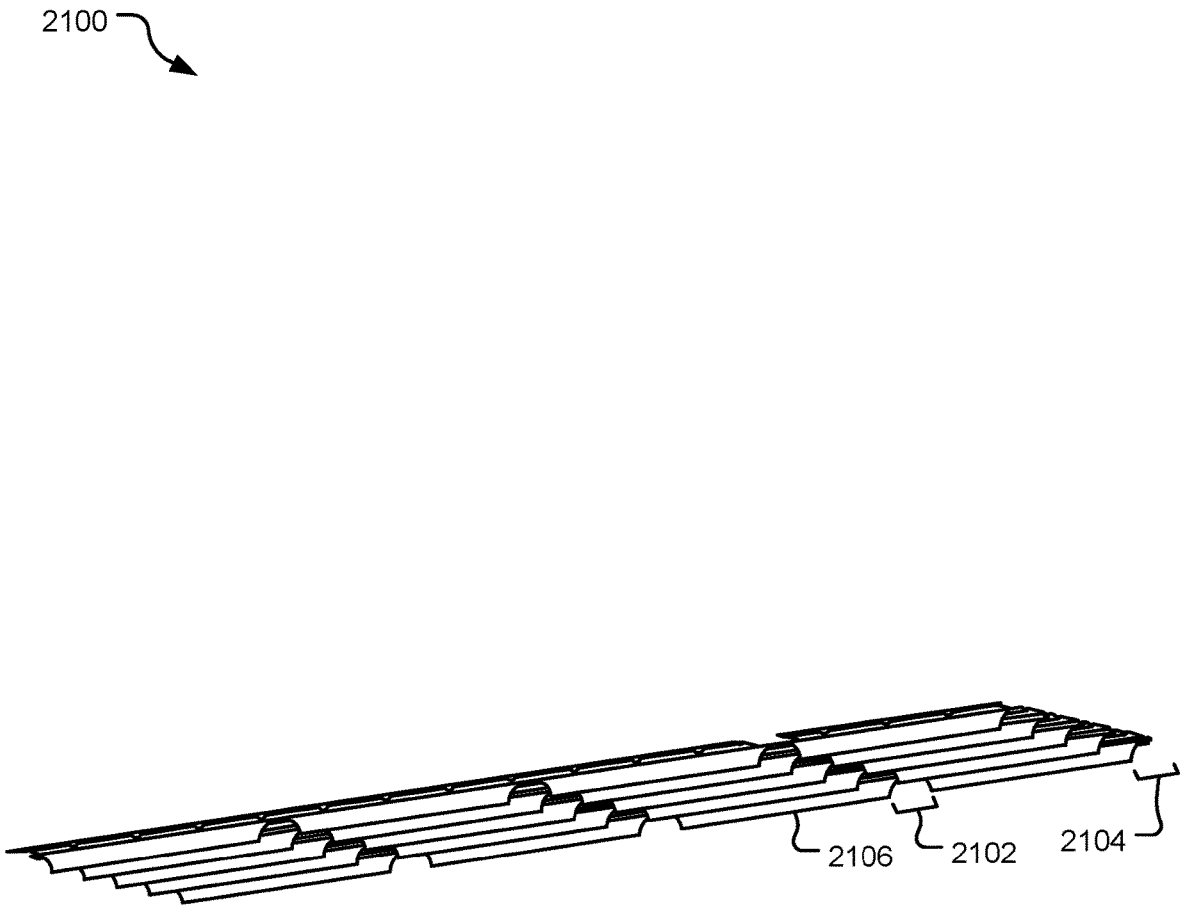

FIG. 21 illustrates a view of an example metal deck disclosed herein.

Figure 22:
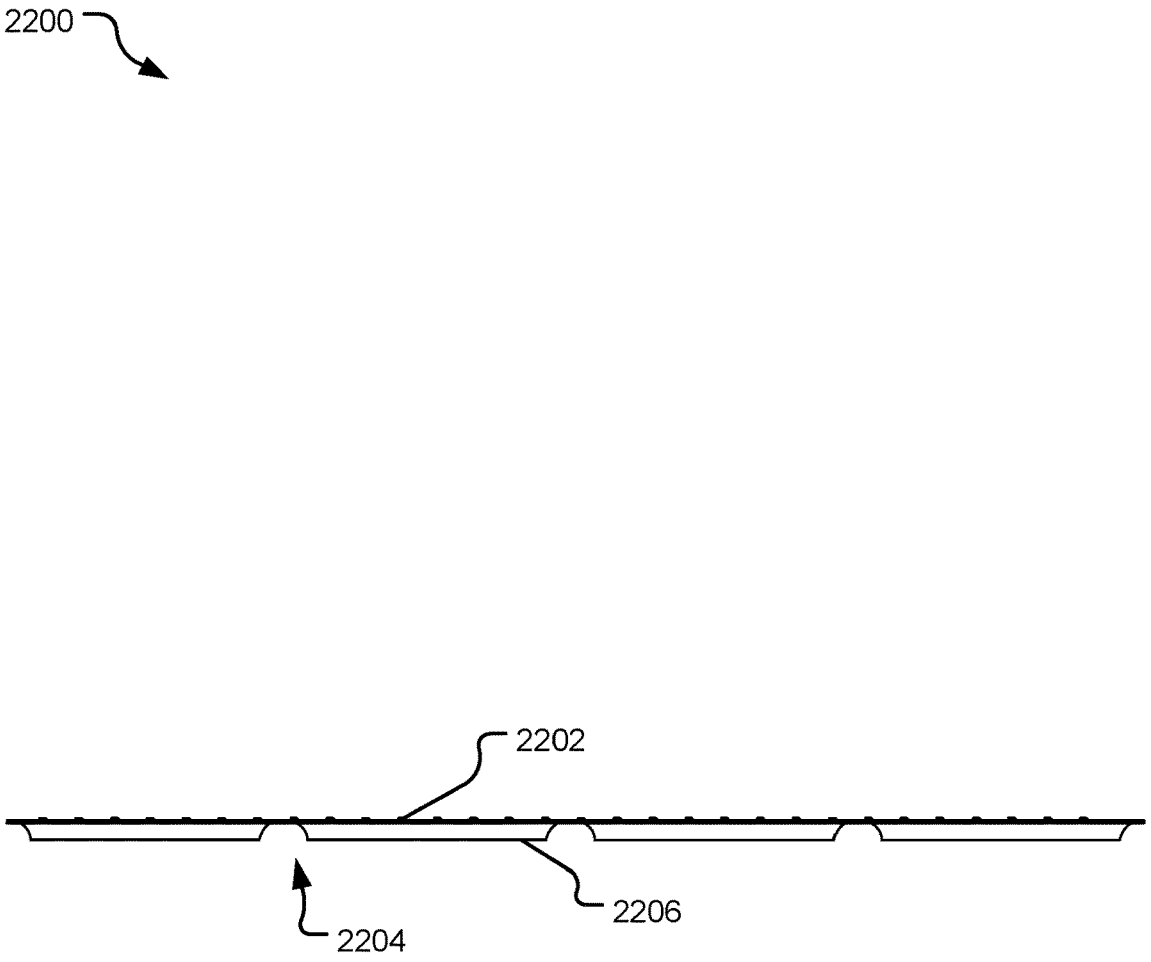

FIG. 22 illustrates a side view of an example metal deck disclosed herein.

DETAILED DESCRIPTIONS

When building single or multiple-story buildings, composite decking may be used for floors and/or ceilings. The composite decking with concrete is used to complete the structural diaphragm of the building. The structural diaphragm in a building ties the vertical and horizontal structural components and makes them perform together to transfer lateral and vertical forces. To place composite decking, a contiguous ribbed sheet of metal is installed, then concrete is poured on the top surface of the metal deck to form the composite deck. In some implementations mesh is placed before concrete is poured to give the concrete rigidity. In various implementations, the metal sheet of the composite decking is used as the mechanism to form the concrete thereon. The process of connecting the metal sheet to structural elements (e.g., I-beams), placing mesh, pouring concrete, and curing the concrete is time consuming and expensive.

In the implementations described herein, a metal deck is provided. The metal deck described herein uses a ribbed structure that has strength qualities such that the metal deck may be utilized as a floor and/or ceiling of a building without concrete. As such, the metal deck described herein provides the strength qualities to complete the structural diaphragm of the building without the expensive and time-consuming process of pouring concrete. A size and shape of a panel of the metal deck may be standardized. The standardization of the metal deck allows for manufacturing of the metal deck using cold roll former machines. In the implementation disclosed herein, the lengths, depth, angles, etc. are standardized. Such standardization reduces the need for repeated engineer design and analysis of metal deck. Furthermore, the standardization also reduces the costs of manufacturing the metal deck. These standardized metal decks can be utilized with other standardized building components such as wall panels, trusses, etc.

In various implementations, a layer of concrete may be poured on top of the metal deck described herein for noise dampening purposes. In these implementations, a sound mat may be placed on the metal deck before the concrete is poured.

Figure 1:
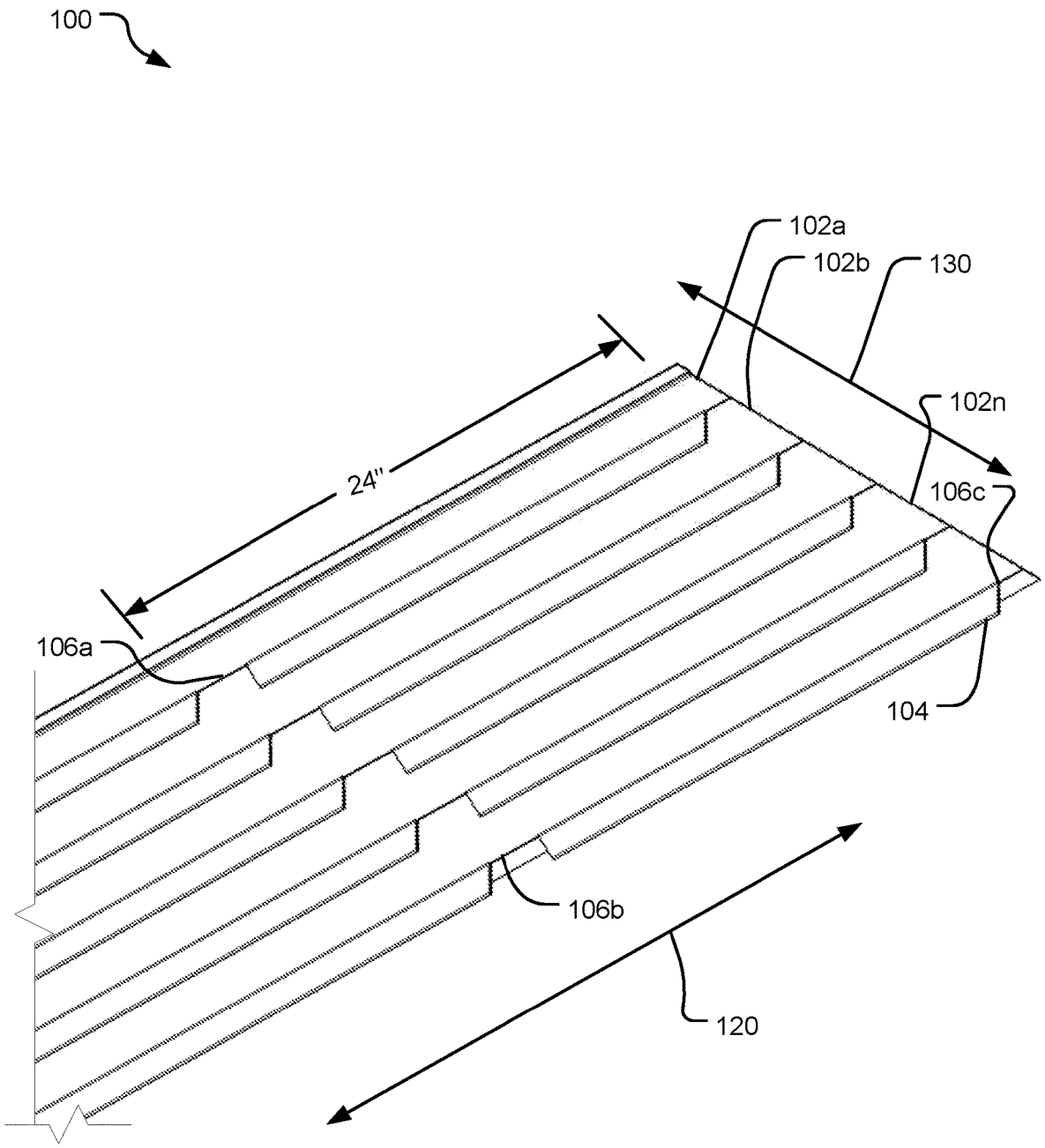
FIG. 1 illustrates a three-dimensional view of an example metal deck disclosed herein.

FIG. 1 illustrates a three-dimensional view of an example metal deck 100 disclosed herein. Specifically, the metal deck 100 includes a plurality of deck components 102*a*, 102*b*, . . . 102*n*. The metal deck 100 may be formed as one contiguous manufactured product having the deck components.

The various metal deck components are joined to each other. For example, the metal deck 100 may be formed from a metal sheet using a roll-former machine. An example roll-former machine may be configured to receive a macro file with instructions for cutting steel rolls at predetermined distances and predetermined angles so that it can be roll formed to generate the metal deck. Furthermore, such a roll former machine is also configured to receive instructions from the macro file regarding placement, punching, etching or cutting of pilot holes for fasteners and other openings. The thickness of the sheet used to form the metal deck 100 may be, for example, 12-18 gauge (between 0.050 to 0.11 inches) for stainless steel sheets. However, alternate thickness of the metal sheet may also be used. Similarly, alternative materials used in building construction, such as galvanized steel, aluminum, etc., may also be used.

Each of the deck components may be configured to have ribs 104 along its length 120. The ribs 104 have folded profile and the ribs face from the downward facing surface of the deck components. In other words, when the deck components are used to form a metal deck, the folded ribs 104 face towards the ground, and a substantially flat surface on the other side of the deck components opposite the ribs 104 faces away from the ground.

Furthermore, the deck components are formed such that the ribs 104 include rib openings 106*a*, 106*b*, 106*c* etc. at predetermined intervals along the length 120. Such rib openings in the ribs 104 are included across the width 130 of the metal deck 100. In other words, the ribs 104 are not continuous along the entire length 120 of the deck components 102. Note that the rib opening 106*c* is illustrated to be at one end of the deck components. Similar rib openings 106 may also be provided at the other end of the deck components. The rib openings 106 are configured to receive a truss structure that supports the metal deck 100.

In one implementation, the ribs 104 between the rib openings 106 are rib flutes that are 21.80 inches in length. Note that in alternative implementations, other length of the rib flutes may be provided. In one implementation, each of the rib openings 106 between the rib flutes may be 2.20 inches. As a result, the distance between the beginnings of each of the rib openings 106 is 24 inches. The dimensions of the lengths of the rib flutes and the rib openings 106 may be selected based on the dimensions of other components of a construction system. For example, if the metal deck 100 is used with trusses that are 21.80 inches apart from each other, the rib flute length is selected to be 21.80 inches. Furthermore, if the width of the trusses is 2.20 inches, the rib openings of 2.20 inches are provided. This allows fitting the metal deck 100 on top of a series of trusses.

FIG. 2A illustrates a side view of a metal deck 200 and FIG. 2B illustrates a top view of the metal deck 200. Referring to FIG. 2A, the metal deck 200 includes ribs 204 with a number of predetermined rib openings 206*a* to 206*e*. Each of the rib openings 206 is configured to receive a truss that may support the metal deck 200. The sides of the ribs openings 206 are at an angle such as to act as a guide to receive the trusses. For example, after the trusses in a structure are installed, a sheet of the metal deck 200 may be placed on top of the trusses, with the trusses being guided to the ribs openings 206 by the slanted angle of the rib openings 206. As such, a person placing the metal deck 200 does not have to force an exact fit over the trusses.

Referring now to FIG. 2B, the metal deck 200 includes a number of deck components 202*a* to 202*e*. The deck components may be formed from one contiguous piece of metal. The ribs 204 extend beneath the metal deck 200 (e.g., in a z-direction), with the predetermined rib openings 206. The rib openings 206 on different ribs are aligned such that a number of parallel rib openings may receive a truss. For example, the rib openings 206 along line 208 may receive a truss.

Figure 3:
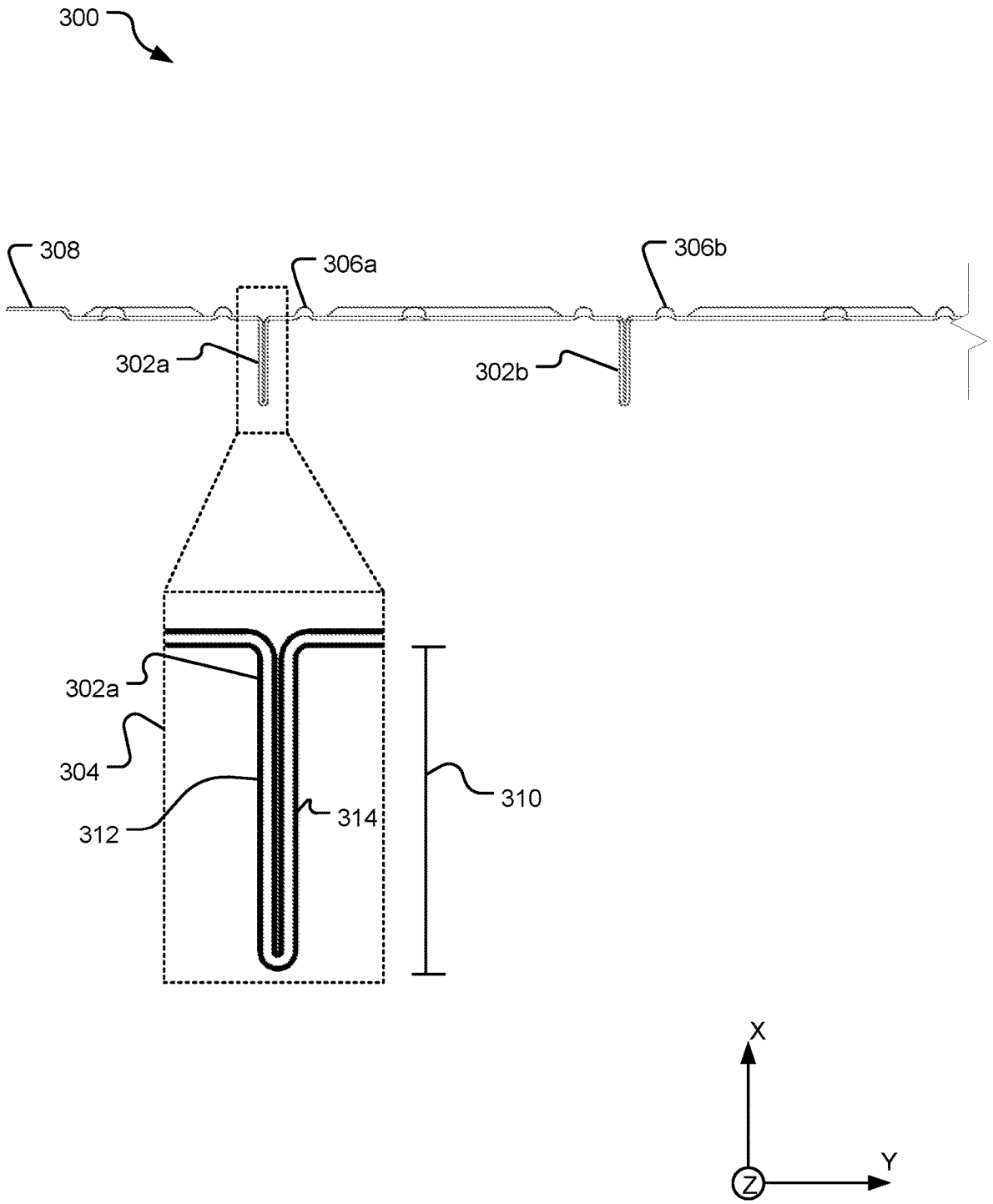
FIG. 3 illustrates a cross-sectional view of an example metal deck.

FIG. 3 illustrates a cross-sectional view of an example metal deck 300. The metal deck 300 includes ribs 302*a* and 302*b* (e.g., rib flutes) and top ribs 306*a* and 306*b*. As illustrated in an expanded view 304 of the rib 302*a*, the rib 302*a* has a folded profile. A height 310 of the rib 302*a* may be, for example, approximately 1.25 inches. The sides 312 and 314 are shown to be perpendicular to the surface of the metal deck 300. In one implementation, the top end of the rib 302*a* may be pinched closed such that the top ends of the sides 312 and 314 are touching each other such as to give the top surface of the metal deck 300 a substantially flat surface. Furthermore, in the illustrated implementation, the top ends of each of the sides 312 and 314 are curved. The ribs provide the deck 300 additional support and give the deck 300 a rigid structure.

The top ribs (e.g., the top rib 306*a*) provide grip or traction for the metal deck 300. For example, the top of the metal deck 300 may be a working surface, the top ribs may provide traction such that people may walk about the top without slipping. The top ribs may be arranged in different patterns. The metal deck 300 further includes an elevated tab 308. The elevated tab 308 is configured to receive a flat portion of another metal deck.

Figure 4:
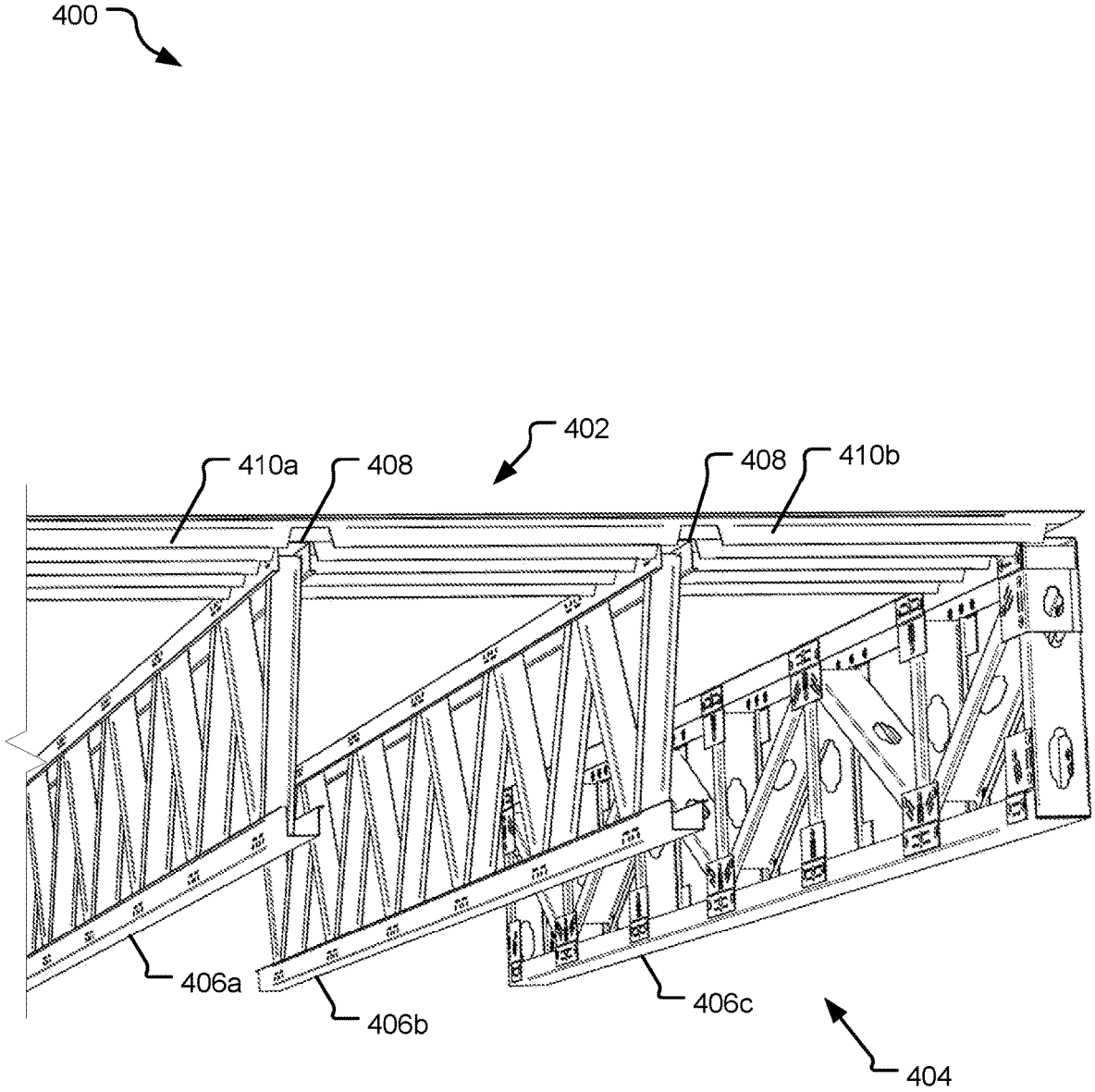
FIG. 4 illustrates a three-dimensional view of an example metal deck disclosed herein on top of a truss structure.

FIG. 4 illustrates a three-dimensional view 400 of an example metal deck 402 disclosed herein on top of a truss structure 404. Specifically, the metal deck 402 including a plurality of ribs 410*a*, 410*b*, etc. having rib openings (e.g., rib openings 408). The metal deck 402 is illustrated as laid on top of the truss structure 404 that includes a plurality of trusses 406*a*, 406*b*, etc. The rib openings are dimensioned to fit around the trusses and the ribs fit between the trusses 406.

Figure 5:
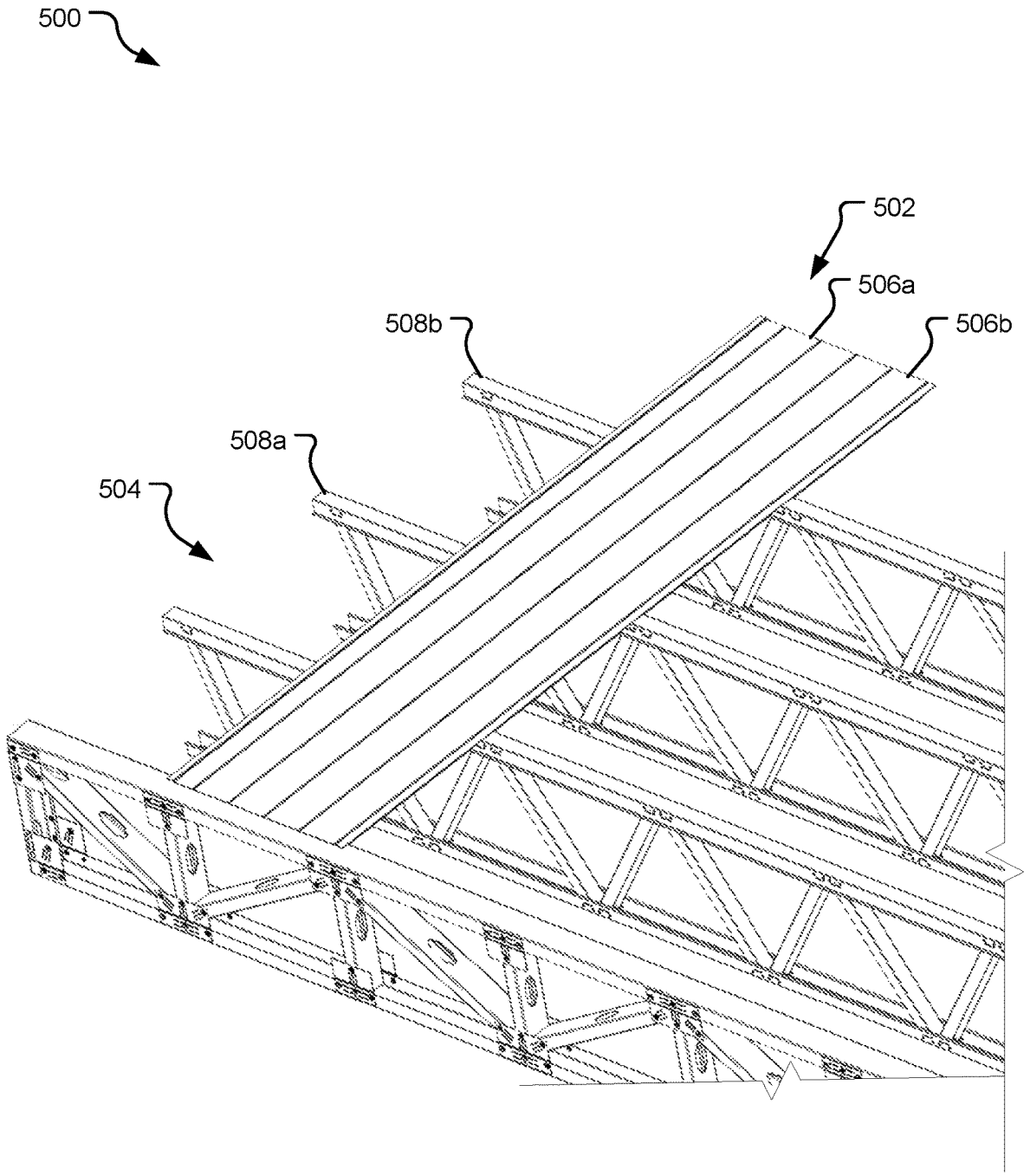
FIG. 5 illustrates an alternative three-dimensional view of an example metal deck disclosed herein on top of a truss structure.

FIG. 5 illustrates an alternative three-dimensional view 500 of an example metal deck 502 disclosed herein on top of a truss structure 504. Specifically, the metal deck 502 includes a plurality of deck components 506*a*, 506*b*, etc. that are laid on top of trusses 508*a*, 508*b*, etc. It should be understood that the metal deck 502 may include a greater or fewer number of deck components than illustrated. It should also be understood that the truss structure 504 may include a greater or fewer number of trusses than illustrated. As such, ribs (not shown) of the metal deck may include a number of rib openings (not shown) to match the number of trusses 508.

Figure 6:
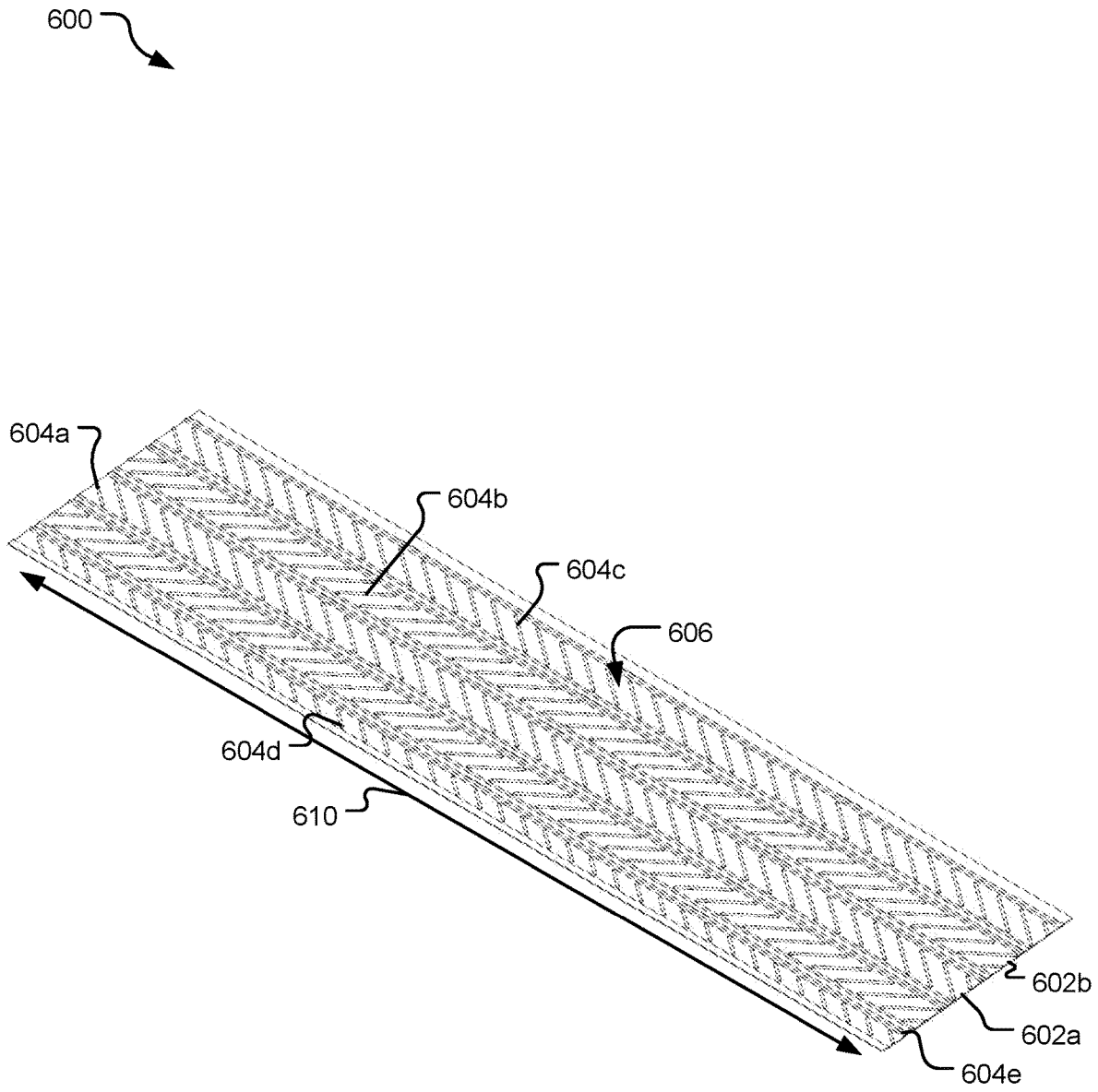
FIG. 6 illustrates an alternative top view of an example metal deck.

FIG. 6 illustrates an alternative top view of an example metal deck 600. The metal deck 600 includes a plurality of deck components 602*a*, 602*b*, etc. A top surface 606 of the metal deck 600 includes a plurality of top ribs 604*a*, 604*b*, etc. Some of the top ribs 604, such as the top rib 604*e*, extend along a length 610 of the metal deck 600. Other top ribs, such as top ribs 604*a*, 604*b*, 604*c* are positioned in a diagonal pattern. It should be understood that the top ribs may be positioned in other patterns. For example, the top rib 604*d* may be positioned perpendicular to top rib 604*e*. The top ribs 604 provide traction for the top surface 606. As such the top surface 606 may be a working surface.

Figure 7:
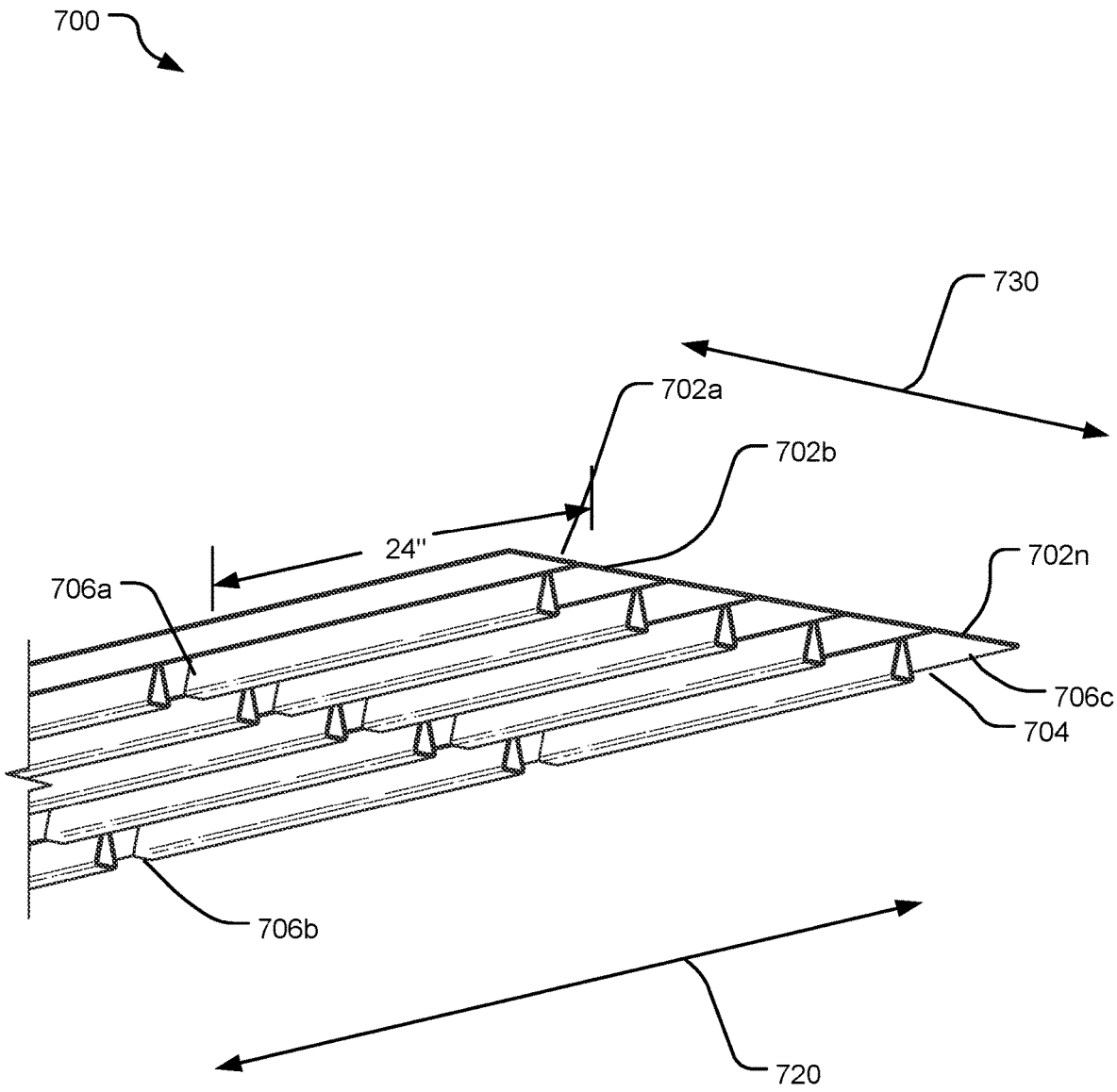
FIG. 7 illustrates a three-dimensional view of an example metal deck disclosed herein.

FIG. 7 illustrates a three-dimensional view of an example metal deck 700 disclosed herein. Specifically, the metal deck 700 includes a plurality of deck components 702*a*, 702*b*, . . . 702*n* (hereinafter referred to as deck components). The metal deck 700 may be formed as one contiguous manufactured product having the deck components joined to each other. For example, the metal deck 700 may be formed from a metal sheet using a roll-forming machine. The thickness of the sheet used to form the metal deck 700 may be, for example, 16-18 gauge (between 0.0625 to 0.0500 inches) for stainless steel sheets. However, alternate thickness of the metal sheet may also be used. Similarly, alternative materials used in building construction, such as galvanized steel, aluminum, etc., may also be used. For example, if standard steel sheet is used to make the deck components 702, the thickness of the deck may be for example, 16-18 gauge standard steel, which equated to thickness of 0.00598 to 0.0478 inches. On the other hand, if galvanized steel sheet is used to make the deck components 702, the thickness of the deck may be for example, 16-18 gauge galvanized steel, which equated to thickness of 0.0635 to 0.0516 inches.

Each of the deck components 702 may be configured to have ribs 704 along its length 720. The ribs 704 are formed in the shape of dovetail and the ribs 704 face the downward facing surface of the deck components 702. In other words, when the deck components 702 are used to form a metal deck, the dovetailed ribs 704 face towards the ground and the flat surface on the other side of the deck components 702 opposite the ribs 704 faces away from the ground.

Furthermore, the deck components 702 are formed such that the ribs 704 are cut at predetermined intervals along the length 720. Such cuts in the ribs 704 are across the width 730 of the metal deck 700. In other words, the ribs 704 are not continuous along the entire length 720 of the deck components 702. Specifically, as illustrated in FIG. 7, each of the deck components 702 has rib openings 706*a*, 706*b*, 706*c* (hereinafter referred to as rib openings 706). Note that the rib opening 706*c* is illustrated to be at one end of the deck components 702. Similar rib opening may also be provided on the other end of the deck components 702.

In one implementation, the ribs 704 are cut along its length 720 to form rib flutes that are 21.80 inches in length. Note that in alternative implementations, other lengths of the rib flutes may be provided. In one implementation, each of the rib openings 706 between the rib flutes may be 2.20 inches. As a result, the distance between the beginnings of each of the rib openings 706 is 24 inches. The dimensions of the lengths of the rib flutes and the rib openings 706 may be selected based on the dimensions of other components of a construction system. For example, if the metal deck 700 is used with trusses that are 21.80 inches apart from each other, the rib flute length is selected to be 21.80 inches. Furthermore, if the width of the trusses is 2.20 inches, the rib openings 706 of 2.20 inches are provided. This allows fitting the metal deck 700 on top of a series of trusses.

FIGS. 8A-8C illustrate example side views of a partial metal deck disclosed herein. Specifically, FIG. 8A illustrates a side view of a metal deck 800 showing a plurality of dovetailed shaped ribs 802 that extend along the z-direction. In one implementation, the metal deck 800 also includes top ribs 804 on its surface such that the top ribs 804 are indented upwards in a direction opposite the ribs 802. The ribs 802 and the top ribs 804 provide bracing or strength to the metal deck system. Furthermore, the top ribs 804 provide traction for the top surface of the deck. Note that if the metal deck 800 was provided to have no ribs, it may deflect under smaller loads, and therefore the metal deck 800 without ribs will not provide sufficient support as a working surface.

FIG. 8B illustrates an expanded view of a rib 810 with the rib 810 having two sides 812 and 814 and a bottom 816. The sides 812 and 814 are shown to have angles 808*a* and 808*b* with respect to the surface of the metal deck 800. Note that in this implementation, these angles 808*a* and 808*b* are approximately similar to each other, giving the rib 810 a symmetrical shape about the x-axis. However, in an alternative implementation, the angles 808*a* and 808*b* may be different from each other based on one or more load balancing requirements. In one implementation, the top end of the rib 810 may be pinched close such that the top ends of the sides 812 and 814 are touching each other. Furthermore, in the illustrated implementation, the top ends of each of the sides 812 and 814 are curved.

FIG. 8C illustrates an expanded view of a top rib 820. The top rib 820 may have a height of approximately 1.25 inches.

Figure 9:
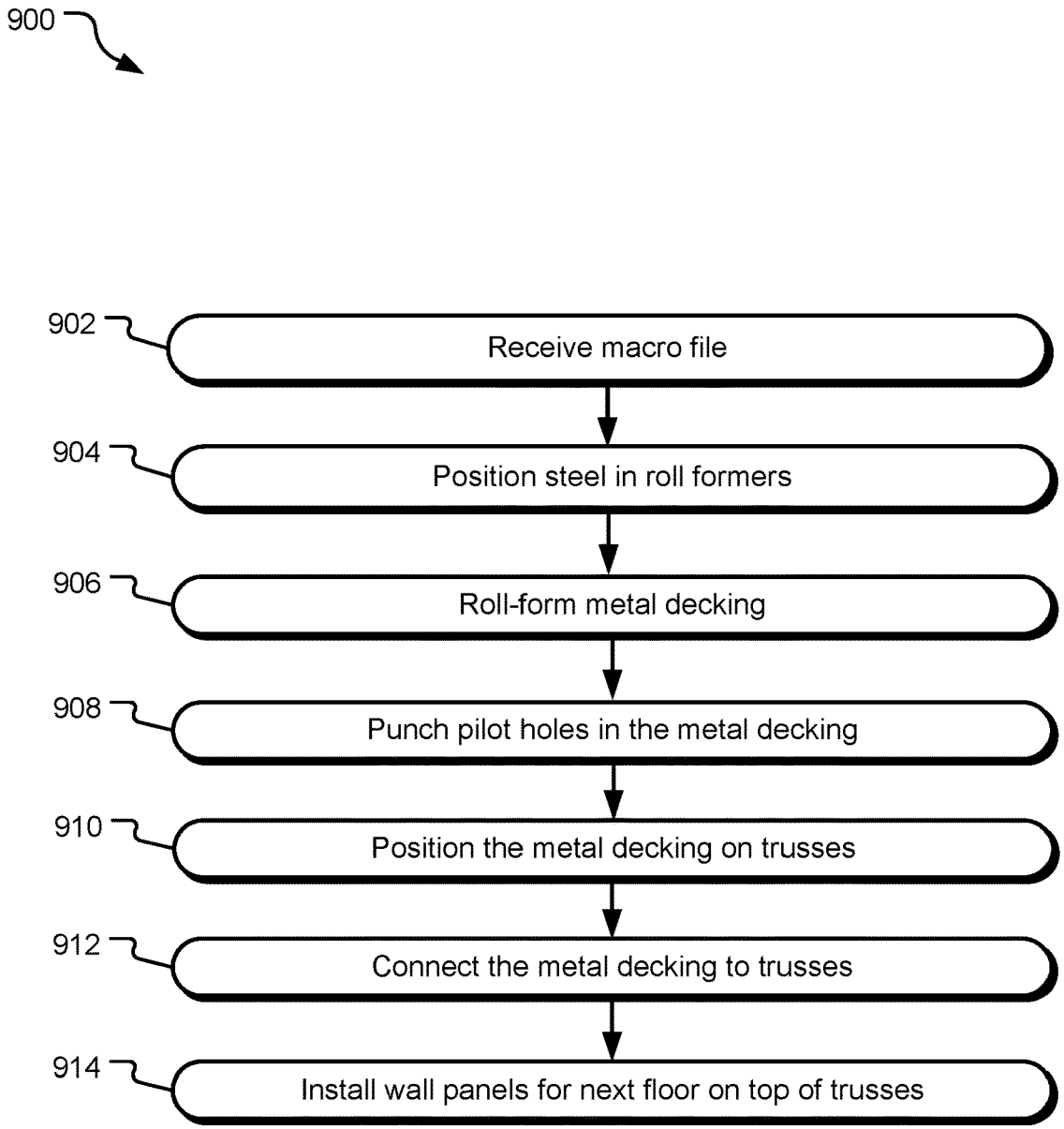
FIG. 9 illustrates example operations for manufacturing and installing metal deck in a building.

FIG. 9 illustrates example operations 900 for manufacturing and installing metal deck in a building. An operation 902 receives a macro file at a roll former machine used to generate various components of buildings. In one implementation, such a macro file may be received from a software application that generates the macro file based on an architectural drawing. At operation 904, steel rolls are positioned in the roll formers. At operation 906, the roll formers interpret the instructions from the macro file to roll form the metal deck. At operation 908, pilot holes are punched in the metal deck. At operation 910, the metal deck is positioned on previously installed trusses. The metal deck is attached to the trusses at operation 912. In operation 914, wall panels for the next floor of the building or installed on top of the metal deck. This process may be repeated for the number of stories in the building.

Figure 10:
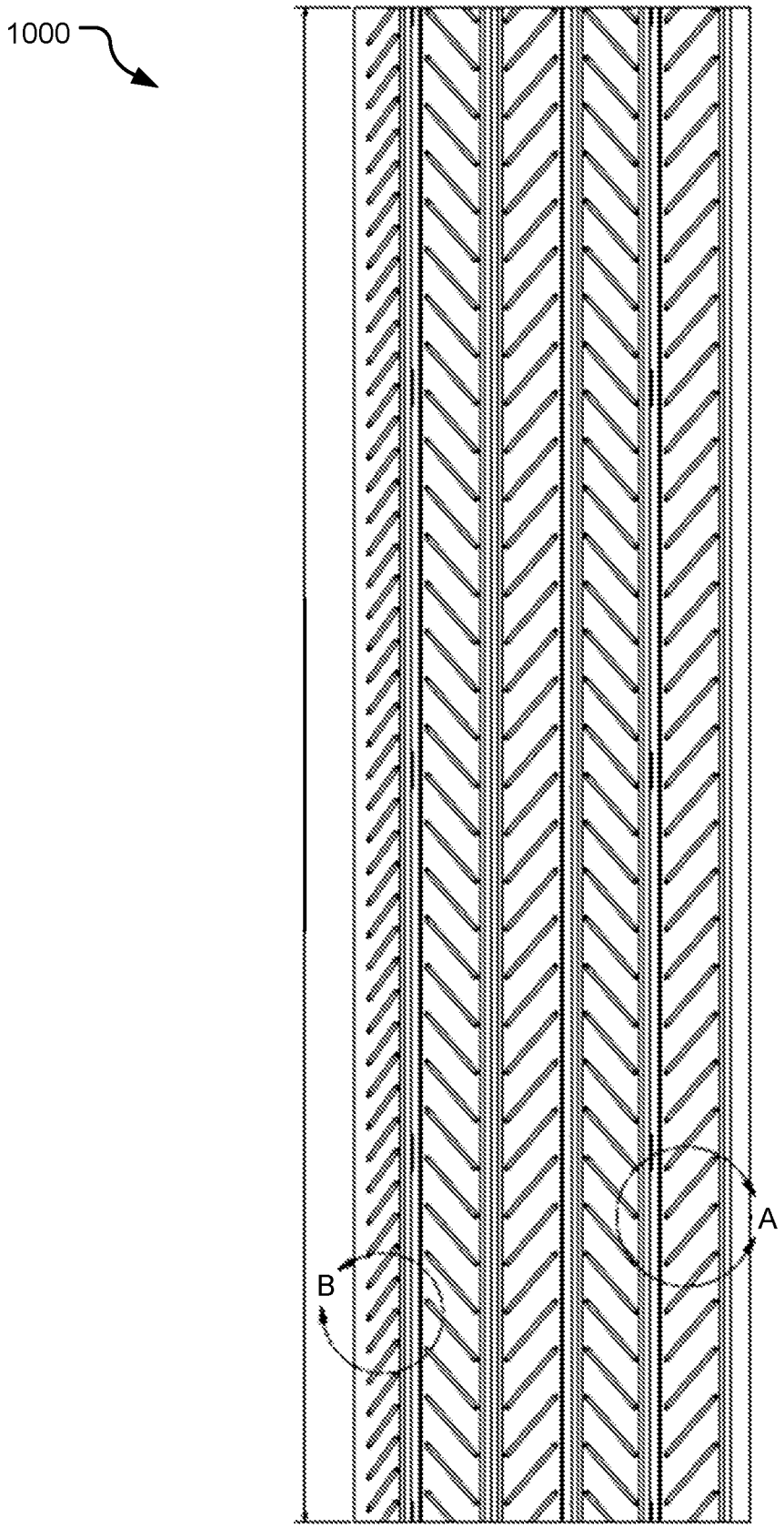
FIG. 10 illustrates an example top view of the metal deck disclosed herein.

FIG. 10 illustrates example top view 1000 of the metal deck disclosed herein. The metal deck disclosed herein may include a number of ribs on the top of the deck. Specifically, these ribs may be at an angle to the length of the metal deck. In example implementations, the length of a sheet of metal deck may be between 2 feet to 20 feet. However, in alternative implementations, other lengths may be available.

FIG. 11 illustrated example top views 1100 of portions of the metal deck disclosed herein. Specifically, the top views 1100 show various example arrangement of the ribs located on top of the metal deck. For example, these ribs may be at an angler of 35 or 40 degrees to an axis along the length of the deck. Alternate arrangements may have alternate angles ranging from 20 to 60 degrees. In one implementation, the length of the top ribs may be between 3.25 to 5.00 inches. However, other lengths may be possible.

FIG. 12 discloses an alternative view 1200 of example metal deck disclosed herein. As shown herein, in an example implementation, an edge of the folded rib may be cut at an angle of 75 degrees (1202) from the surface of the metal deck to accommodate a truss therein. Furthermore, in the illustrated implementation, the folded ribs may have openings at intervals of approximately two feet. The metal deck may have an open edge at each end of approximately 1.125 inches.

FIG. 13 illustrates yet another alternative view 1300 of example metal deck disclosed herein. Details of sections 1302 and 1304 are described in further detail below in FIGS. 14 and 15.

FIG. 14 illustrates a side view 1400 of the example metal deck disclosed herein. As shown herein, the side view 1400 illustrates the length of the folded rib 1402 being approximately 1.25 inches. The thickness of the folded rib 1402 may be approximately 0.13 inches.

FIG. 15 illustrates another alternative side view 1500 of the metal deck disclosed herein. As shown by 1502, the metal deck may bend at the edge to approximately 88 degrees (from 90 degrees) when loaded, thus giving flexibility to the edge of the metal deck. The top ribs may be placed approximately 0.57 inches away from the folded rib.

FIG. 16 illustrates another view of another example metal deck 1600 disclosed herein. The metal deck 1600 may be formed, by a roll-forming machine for example, of a sheet of 14-18 gauge steel. The metal deck 1600 includes a number of deck components (e.g., a deck component 1602), that extend substantially the length of the metal deck 1600. A number of deck components are formed along the width of the metal deck 1600. The deck components include an elevated portion and a ribbed section. For example, the deck component 1602 includes an elevated portion 1604 (also referred to as the elevated section 1604) and a ribbed portion 1606 (also referred to as the ribbed section 1606). When the metal deck 1600 is installed on a truss structure (such as the truss structure 2004 of FIG. 20), the elevated portion 1604 provides spacing between the metal deck 1600 and the truss structure such as to provide sound insulation/dampening. For example, sound vibrations that reach the metal deck 1600 are dissipated by the spacing (e.g., air) provided by the elevated portion 1604. As illustrated in FIG. 16, the metal deck 1600 includes a number of elevated portions that extend the length of the metal deck 1600 comprising a majority of the area of the metal deck 1600. Accordingly, a majority of the surface area of the metal deck 1600 is elevated above the truss structure to provide sound control/dissipation.

A number of protrusions are placed along the length of the elevated portion 1604. For example, the elevated portion 1604 includes a protrusion 1608. In the illustrated implementation, the protrusions 1608 are substantially frustoconically shaped, but it should be understood that other shapes (e.g., trapezoidal prism) for the protrusions 1608 are contemplated. The protrusions may be formed using a punching or etching device or machine. In the illustrated implementation, the protrusions 1608 include an opening, but it should be understood that in alternative implementations, the protrusions 1608 may not include openings. The protrusions 1608 provide an undulated surface for gripping or traction control purposes. For example, the protrusions may provide some traction for workers traversing the metal deck 1600. Similarly, the protrusions provide a surface area for binding with concrete poured on top of the metal deck 1600.

The ribbed portions 1606 of the deck components 1602 of the metal deck 1600 provide undulated surface area for gripping purposes as well as stiffness and support. In other words, the ribbed portions prevent substantial deflection of the metal deck 1600. In one implementation, the ribbed portions 1606 comprise two rib troughs arranged on either side of two adjacent elevated ribs. The two elevated ribs are positioned on either side of a rib flute (such as the rib flutes 1814 of FIG. 18) that extend substantially the length of the metal deck 1600. The rib flutes include cutouts for receiving truss structures such that the metal deck may rest substantially against the truss structures. Furthermore, the rib flutes provide more stability (stiffness and reduced deflection) for the metal deck 1600. The ribbed portions extend substantially (or the entire) the length of the metal deck 1600.

The metal deck 1600 further includes optional cutouts (e.g., a cutout 1610) on the side of the metal deck 1600. The cutouts may be included such that the metal deck 1600 may fit around a portion of a structural post of a building. The positioning of various cutouts depends on the arrangement of structural posts in a building. In some implementations, the metal deck 1600 may not include cutouts for structural posts because such a metal deck may not be positioned near a structural post. The metal deck 1600 includes an end cutout 1612 for receiving a structural post. The placement and size of end cutouts 1612 also depend on the layout of structural posts within a building or structure. It should be understood that FIG. 16 illustrates only a portion of the metal deck.

FIG. 17 illustrates a top view of an example metal deck 1700 disclosed herein. The metal deck 1700 is only partially illustrated. The metal deck 1700 includes a number of deck components (e.g., a deck component 1702) that include an elevated portion and a ribbed portion. The ribbed portions provide strength, stiffness, and prevent substantial deflection in the metal deck 1700. The elevated portions are elevated above any truss structures (not shown) that the metal deck is positioned above. The elevated portions provide spacing between the metal deck 1700 in the truss structure so as to provide sound control/dissipation. The ribbed portions and protrusions on the elevated portions (e.g., a protrusion 1704) provide traction control on the metal deck 1700.

The metal deck 1700 includes various cutouts 1706, 1708, 1710, and 1712 positioned around various edges of the metal deck 1700. The cutouts 1706, 1708, and 1710 are for receiving/surrounding various structural posts/columns in a building or structure. The positions, sizes, and shapes of the cutouts 1706, 1708, 1710, etc. depend on the placement of the structural posts/columns in a building or structure. It should be understood that a metal deck may include greater or fewer number of cutouts than illustrated in FIG. 17. In some implementations, a metal deck does not include any cutouts.

FIG. 18 illustrates a side cross-sectional view of an example metal deck 1800 disclosed herein. Specifically, FIG. 18 illustrates the profile of various sections included in the metal deck 1800. For example, a deck component 1802 includes an elevated portion 1804 and a ribbed portion 1806. When the metal deck 1800 is installed on a truss structure (such as the truss structure 2004 of FIG. 20), the elevated portion 1804 does not contact the truss structure and provides spacing between the metal deck 1800 and the truss structure. Such spacing provides sound control/dissipation such that sound waves traveling through the metal deck 1800 are dissipated by the air in the spacing provided by the elevated portions. The elevated portions 1804 further include protrusions (e.g., a protrusion 1808) that provide traction control on top of the metal deck 1800.

The ribbed portions (e.g., a ribbed portion 1806) provide support, stiffness, and prevent substantial deflection in the metal deck 1800. The ribbed portions 1806 include two rib troughs (e.g., a rib trough 1810) arranged on either side of two adjacent elevated ribs (e.g., an elevated rib 1812). Rib flutes (e.g., a rib flute 1814) are formed between the two adjacent elevated ribs of the ribbed portions 1806. The rib flutes 1814 extend from the bottom of and away from the metal deck 1600. The two adjacent elevated ribs have a rib flute in between that extends down beneath the metal deck 1800. Portions of the bases of rib troughs 1810 may rest against truss structures. The rib troughs 1810, along with the elevated ribs 1812 provide support for the elevated portions of the metal deck 1800. The rib flutes 1814, the rib troughs 1810, and the elevated ribs 1812 extend substantially the length (e.g., in a direction substantially parallel to the z-axis) of the metal deck 1600. The rib flutes 1814 extend down from the bottom of the metal deck (e.g., in a direction substantially parallel to the x-axis and opposite to the x-axis as shown). Each of the profile sections (e.g., deck components) are configured along the width of the metal decking (e.g., along an axis parallel to the y-axis) and extend substantially the length (e.g., along an axis parallel to the z-axis) of the metal deck.

As illustrated in FIG. 18, the edges of the metal deck 1800 may be formed to have different profiles. Such a configuration allows the multiple metal decks to be placed adjacent to one another such that the end sections are in an overlapping configuration. For example, the metal deck 1800 includes a first edge 1816 with a narrow trough rib 1818 and an elevated flange 1820. The metal deck 1800 also includes a second edge 1822 that includes a rib trough 1824, an elevated rib 1826, a rib flute 1828, and a flange 1830 (e.g., a flat flange). If the first edge 1816 (of another metal deck) was positioned adjacent to the second edge 1822, the flange 1830 would extend beneath the elevated flange 1820 of the first edge 1816. The illustrated configuration provides support and allows the various metal deck to be fixably placed adjacent to one another. In some implementations, the metal decking 1800 incudes ribbed flutes that are dovetail shaped, such as the ribbed flutes 702, 802 illustrated in FIG. 7 and FIG. 8.

FIG. 19 illustrates a side cross-sectional view 1900 of an example metal deck 1902 disclosed herein positioned on top of a truss structure 1904. The truss structure 1904 includes a top chord 1906 on which the metal deck 1902 is positioned. The top chord 1906 is positioned in cut out openings (such as the openings 2008 of FIG. 20) positioned in each of the plurality of the rib flutes (e.g., a rib flute 1908) of the metal deck 1902. The metal deck 1902 includes a plurality of deck components including elevated sections (e.g., an elevated section 1910). The elevated sections 1910 provide sound insulation between the metal deck 1902 and the truss chord 1906. The elevated sections 1910 are supported by adjacent rib troughs. For example, the elevated section 1910 is supported by adjacent rib troughs 1912 and 1914. The base of the rib troughs 1912 and 1914 contacts the top surface of the truss chord 1906. Thus, any force applied to the elevated section 1910 is transferred to the truss via the rib troughs 1912 and 1914.

The trusses of the truss structure 1904 are positioned in an axis parallel to the y-axis, and the metal deck 1902 includes a length that is positioned in an axis parallel to the z-axis. The rib flutes 1908 extend substantially the length (e.g., except for the cut-out openings for receiving the trusses) of the metal deck and are thus parallel to the z-axis. The rib flutes 1908 and the trusses are positioned substantially perpendicular to each other.

FIG. 20 illustrates another view 2000 of an example metal 2002 deck disclosed herein positioned on top of a truss structure 2004. The truss structure 2004 is partially illustrated and includes a number of trusses, such as a truss 2010. The metal deck 2002 incudes a plurality of rib flutes (e.g., a rib flute 2006) including a number of cut-out openings (e.g., a cut-out opening 2008) for receiving top chords of the various trusses 2010. The cut-out openings allow the deck 2002 to fixably positioned on top of the truss structure 2004 such that the metal deck 2010 does not substantially shift or slide with respect to the truss structure. Furthermore, when a plurality of metal decks are positioned in an overlapping configuration, as described above with respect to FIG. 18, then the plurality of metal decks are further prevented from shifting/sliding by the trusses 2010 and the overlapping configuration of the metal decks 2002.

FIG. 21 illustrates a view of an example metal deck 2100 disclosed herein. The metal deck 2100 includes a plurality of rib flutes (e.g., a rib flute 2106) extending beneath the metal deck. The rib flutes 2106 include cut-out openings (e.g., an opening 2102) for receiving trusses (or top chords of a wall panel) of a building. The rib flutes 2106 further include end openings (e.g., an end opening 2104) for receiving a portion of a metal deck or wall structure. The end openings 2104 allow for two metal decks to be placed end to end such that the adjacent ends are both positioned on top of a truss or wall structure.

To manufacture the metal deck 2200, a roll form machine may interpret a macro-file defining the dimensions of the metal deck to create (e.g., operation 906 of FIG. 9) the metal deck 2200. A contiguous metal sheet may bent/rolled/folded in to the shape of the metal deck 2100. The machine may form the rib flutes 2104, elevated ribs (e.g., elevated ribs 1812 of FIG. 18), rib troughs (e.g., rib trough 1810 of FIG. 18), elevated sections (e.g., elevated section 1804 of FIG. 18), and protrusions (e.g., protrusion 1808 of FIG. 18) using various forming elements such as rollers, folders, etching devices, presses, etc. The cut-out openings in the ribbed flutes (e.g., opening 2102 and 2104) may be formed (e.g., etched or cut) during or after the flutes are formed. Furthermore, various cutouts around the edges of the metal deck 2100 (e.g., for receiving structural posts/columns) may be formed after the metal deck is substantially formed.

FIG. 22 illustrates a side view of an example metal deck 2200 disclosed herein. The metal deck 2200 includes a plurality of rib flutes (e.g., a rib flute 2206) with a number of openings (e.g., an opening 2204) for receiving a truss or wall structure. The metal deck further includes a plurality of protrusions (e.g., a protrusion 2202) positioned along the top surface (e.g., on an elevated section). The protrusions 2202 provide traction control for the metal decking.

The above specification, examples, and data provide a complete description of the structure and use of exemplary embodiments of the invention. Since many embodiments of the invention can be made without departing from the spirit and scope of the invention, the invention resides in the claims hereinafter appended. Furthermore, structural features of the different embodiments may be combined in yet another embodiment without departing from the recited claims. Although the present invention has been described with reference to preferred embodiments, workers skilled in the art will recognize that changes may be made in form and detail without departing from the scope of the invention. The implementations described above and other implementations are within the scope of the following claims.

What is claimed is:

1. A metal deck comprising:

one or more of deck components formed in a metal sheet, one or more of the deck components formed along a width of the metal deck and including an elevated section and a ribbed section, the ribbed section including a rib flute extending from a bottom surface of the metal deck, the ribbed section further including a first elevated rib positioned adjacent to a first side of the rib flute and a second elevated rib positioned adjacent to a second side of the rib flute.

2. The metal deck of claim 1 wherein each of the rib flutes of the one or more of deck components includes sides that are formed perpendicular to the bottom surface of the metal deck.

3. The metal deck of claim 1 wherein each of the rib flutes are dovetail shaped ribs.

4. The metal deck of claim 1 wherein the elevated section is configured to provide sound insulation between the metal deck and a truss structure.

5. The metal deck of claim 1 wherein the ribbed section including the rib flute, the first elevated rib, and the second elevated rib extending along a length of the metal deck.

6. The metal deck of claim 1 wherein the ribbed section further includes a first rib trough positioned adjacent to the first elevated rib and a second rib trough positioned adjacent to the second elevated rib, the first rib trough and the second rib trough being substantially parallel to the rib flute.

7. The metal deck of claim 1 wherein the elevated section further includes one or more protrusions positioned along the length of the elevated section, the one or more of protrusions providing traction control for the elevated section.

8. The metal deck of claim 1 wherein each of the rib flutes includes one or more rib openings for receiving portions of the truss structure such that the metal deck may be fixably positioned on top of the truss structure.

9. The metal deck of claim 1 further comprising:

a first edge extending the length of the metal deck, the first edge including an elevated flange; and a second edge extending the length of the metal deck, the first edge including a flat flange, the first edge and the second edge for positioning the metal deck to one or more additional metal decks in an overlapping configuration.

10. The metal deck of claim 1 wherein the elevated section is positioned between two rib troughs, the two rib troughs providing support for the elevated section.

11. A structural system, comprising:

two or more trusses positioned parallel to each other; and a metal deck positioned on the two or more trusses and including one or more deck components formed, the one or more of the deck components formed along a width of the metal deck and including an elevated section and a ribbed section, the ribbed section including a rib flute extending from a bottom surface of the metal deck, the ribbed section further including a first elevated rib positioned adjacent to a first side of the rib flute and a second elevated rib positioned adjacent to a second side of the rib flute.

12. The structural system of claim 11 wherein each of the rib flutes includes at least two rib openings, each of the at least two rib openings configured to receive the two or more trusses such that the metal deck is fixably positioned on the two or more trusses and the first elevated rib and the second elevated rib being substantially parallel to the rib flute.

13. The structural system of claim 11 wherein each of the rib flutes of the one or more deck components includes sides that are formed perpendicular to the bottom surface of the metal deck.

14. The structural system of claim 11 wherein each of the rib flutes of the one or more deck components is a dovetailed shaped rib.

15. The structural system of claim 11 wherein the ribbed section further includes a first rib trough positioned adjacent to the first elevated rib and a second rib trough positioned adjacent to the second elevated rib, the first rib trough and the second rib trough being substantially parallel to the rib flute.

16. The structural system of claim 11 wherein the elevated section further includes one or more protrusions positioned along the length of the elevated section, the one or more protrusions providing traction control for the elevated section.

17. The structural system of claim 11 wherein the metal deck further comprises:

a first edge extending the length of the metal deck, the first edge including an elevated flange; and a second edge extending the length of the metal deck, the first edge including a flat flange, the first edge and the second edge for positioning the metal deck to one or more additional metal decks in an overlapping configuration.

18. The structural system of claim 11 wherein the metal deck includes one or more cutouts are positioned in one or more edges of the metal deck, the one or more cutouts configured to receive one or more structural posts of a building.

19. The structural system of claim 11 wherein the each of the rib flutes are positioned substantially perpendicular to the two or more trusses.

20. The structural system of claim 11 wherein the elevated section is positioned between two rib troughs, the two rib troughs providing support for the elevated section.

* * * * *